US007775299B2

(12) United States Patent
Khan et al.

(10) Patent No.: US 7,775,299 B2
(45) Date of Patent: Aug. 17, 2010

(54) METHOD AND APPARATUS FOR PROGRAMMABLE PRESSURE DRILLING AND PROGRAMMABLE GRADIENT DRILLING, AND COMPLETION

(76) Inventors: Waqar Khan, 41G Block Model Town, Lahore (PK) 54700; Geoff Downton, 3430 Williams Glen Dr., Sugar Land, TX (US) 77479

( * ) Notice: Subject to any disclaimer, the term of this patent is extended or adjusted under 35 U.S.C. 154(b) by 124 days.

(21) Appl. No.: 11/968,010

(22) Filed: Dec. 31, 2007

(65) Prior Publication Data

US 2008/0264690 A1 Oct. 30, 2008

(30) Foreign Application Priority Data

Apr. 26, 2007 (GB) ..... 0708041.9

(51) Int. Cl.
*E21B 21/08* (2006.01)

(52) U.S. Cl. ..... 175/57; 175/48; 175/25; 166/250.07

(58) Field of Classification Search ..... 175/25, 175/48, 57; 166/250.07
See application file for complete search history.

(56) References Cited

U.S. PATENT DOCUMENTS

| | | | | |
|---|---|---|---|---|
| 5,803,186 | A * | 9/1998 | Berger et al. | 175/50 |
| 5,873,420 | A | 2/1999 | Gearheart | |
| 5,954,137 | A | 9/1999 | Coronado et al. | |
| 6,236,620 | B1 * | 5/2001 | Schultz et al. | 367/82 |
| 6,732,804 | B2 | 5/2004 | Hosie et al. | |
| 7,086,481 | B2 | 8/2006 | Hosie et al. | |
| 7,096,975 | B2 * | 8/2006 | Aronstam et al. | 175/25 |
| 2007/0068704 | A1 * | 3/2007 | Krueger et al. | 175/57 |
| 2008/0029306 | A1 * | 2/2008 | Krueger et al. | 175/210 |
| 2008/0035374 | A1 * | 2/2008 | Reitsma | 175/25 |
| 2008/0060846 | A1 * | 3/2008 | Belcher et al. | 175/25 |

* cited by examiner

*Primary Examiner*—Shane Bomar
(74) *Attorney, Agent, or Firm*—Steven M. Jensen; Edwards Angell Palmer & Dodge LLP

(57) ABSTRACT

A method for creating a programmable pressure zone adjacent a drill bit bottom hole assembly by sealing near a drilling assembly, adjusting the pressure to approximately or slightly below the pore pressure of the well bore face to permit flow out of the formation, and, while drilling, adjusting by pumping out of, or choking fluid flow into, the drilling assembly between the programmable pressure zone and the well bore annulus to avoid overpressuring the programmable pressure zone unless required to control the well.

16 Claims, 20 Drawing Sheets

METHOD AND APPARATUS FOR PROGRAMMABLE PRESSURE DRILLING AND PROGRAMMABLE GRADIENT DRILLING, AND COMPLETION

This patent application claims priority to GB0708041.9, filed 26 Apr. 2007.

FIELD OF INVENTION

A method and apparatus for drilling and completion of hydrocarbon wells is disclosed; more, specifically, a method for establishing a sealed chamber adjacent a drilling bottom hole assembly and selectively adjusting the pressure within that chamber to be maintainable at a pressure avoiding formation damage, fluid loss, and skin damage, while allowing higher drilling rates, with increased drill bit life, minimizing differential wall sticking, and maximizing formation information gathered from the formation as drilling proceeds, and a method to permanently case and cement after drilling is completed while maintaining the well bore integrity. The apparatus can provide a formation preserving seal as drilling proceeds to facilitate an open hole completion, while maintaining the well bore integrity. A method is disclosed to permanently case and cement a well with such a formation preserving seal installed across multiple zones at different formation pressures

BACKGROUND OF INVENTION

Terminology

Underbalanced drilling (UBD) is drilling a well with a drilling fluid hydrostatic head below the reservoir pore pressure. Managed pressure drilling (MPD) involved "low-head" and "at balance" drilling, in which the bottom hole pressure was kept marginally above or equal to the reservoir pore pressure. Reverse Circulation Center Discharge (RCCD) is drilling a well underbalanced while minimizing drilling fluid contact with the formation walls. Because all drilling can be considered managed pressure drilling in a generic sense, as used herein, Programmable Pressure Drilling (PPD), shall mean an adaptive well construction process used to precisely control the down hole annular pressure within specified environment limits by dynamically calculating, adjusting and applying a positive or negative pressure offset during drilling and while cementing. Further, a Programmable Gradient Drilling (PGD) system shall mean an adaptive well construction process that employs PPD methodology to thereby allow a variable pressure offset to be applied in a modulating fashion over incremental sections of well bore while drilling without disturbing the pressure within rest of the wellbore, resulting in a fully programmable annular pressure profile or gradient in which to further case and complete the well. PPD and PGD could further be understood as Programmable Automated Pressure Drilling (PAPD) or Programmable Automated Gradient Drilling (PAGD) with increasing utilization of automated process control loops.

PPD describes maintenance of bottom hole pressure at a specific pressure differential in the drilling zone. This is accomplished by utilization of a control unit and seal assembly. A stationary seal unit installed at a desired location in the borehole maintains pressure on the proximal side of both the control and seal unit at a pressure sufficient to control the well, provide sufficient flow to effect cooling of the bit using drilling mud being circulated through the drilling zone, and provide a flow rate sufficient to carry drill cuttings from the distal side of the control and seal units to the proximal side of the control and seal units and onwards back to the surface. The seal permits drilling to continue on the distal side of a movable control unit, while maintaining a pressure differential in the drilling zone from that pressure experienced on the proximal side of the seal.

PGD describes the additional aspect of an incremental deployment of a formation preserving seal on the formation wall, either chemical or mechanical in nature while performing PPD, to act as a pressure barrier as well as to strengthen the formation incrementally thereby simultaneously providing for a movable seal unit in close proximity to the movable control unit, where movement of both units is closely coordinated with the movement of the drilling assembly.

Conventional drilling practices or OBD have typically maintained the hydrostatic pressure of the drilling fluid in the well bore between the formation's pore pressure and its fracture pressure. Drilling fluid is continuously circulated within the well bore to control the formation fluids and transport cuttings to the surface. The drilling fluid also acts to stabilize the well bore and lubricates and cools the drill bit.

The present invention seeks to combine OBD to minimize the safety risks typically associated with UBD, such as $H_2S$ release, unforeseen and unplanned release of substantial quantities of hydrocarbons into the well bore ("a kick") or where environmental regulations prohibit flaring or production while drilling, with the benefits of MPD or UBD in the drilling zone. Such methods avoid damage to the formation, lost circulation and all the other well-known problems. Moreover, the present invention avoids the need of drilling structure outfitted with the extra equipment commonly found with UDB or MPD programs, such as nitrogen injection units, closed tank batteries, multiphase separators, rotating choke devices, vacuum degassers and the like.

Typically drilling fluid is either a water-based or oil-based liquid and contains a variety of solid and liquid admixtures to impart density, fluid loss characteristics and Theological properties specific to the well bore conditions experienced or predicted. These conventional drilling methods have long been recognized as the safest way to drill a well despite recognizable problems created by this hydrostatic head of drilling fluid above a formation of interest. Since the drilling fluid pressure is higher than the natural formation pressure, fluid invasion frequently occurs causing permeability damage to the formation, caused by washout of the formation or physical blockage from the intrusion of the fluid and solids into the formation structure itself.

UBD was developed as drilling with a well bore fluid gradient less than the natural formation pressure gradient, which thereby permits the well to flow while drilling proceeds. This technique minimizes lost circulation and increases penetration rates while minimizing damage caused by the invasion of drilling fluid into the formation structure. Production zones are identified immediately and detailed well profiles can be formed from the progress of the drilling program in these underbalanced wells, leading to shortened drilling times—especially in marginal or older geological formations.

Reduced drilling time, increased bit life, early detection of formation changes and dynamic testing of productive intervals in the formation being drilled are enhanced by using UBD. Increased drilling efficiency, along with enhanced recovery prospects from undamaged formations, makes underbalanced drilling highly desirable.

UBD, as currently practiced, requires special surface equipment to safely and effectively drill. Density control of the drilling fluid is typically achieved by nitrogen injection into either the drill pipe or a parasite pipe. This requires significant surface preparation to effect appropriate nitrogen injection. Surface chokes to control bottom hole pressure can be employed to raise or lower the standpipe pressure, but the operation of the choke is not experienced by the bottom hole assembly because of the inherent lag time. The estimation of the lag time is normally straight forward for single phase systems, but multiphase flow systems are complex and difficult to model and hence difficult to predict their response, let alone control and manage it precisely.

UBD can result in a higher risk of blowout, fire or explosion if not managed properly; moreover, it requires rig crews to be fully trained in a totally different system, occupies large deck space and needs additional bed space which are normally very constrained offshore and is typically more expensive because of the additional surface equipment required for nitrogen injection and multiphase flow chokes and separation equipment. Yet, despite all of these problems, UBD is still widely used in modern drilling programs because the benefits far outweigh the costs.

MPD is known in the industry as a group of technologies to precisely control the annular pressure profile in the wellbore. The need to have precise control on the profile of annular pressure at all times during drilling and cementing is well established as it allows drilling through and completing complex pore and fracture pressure regimes, improving drilling efficiency due to reduced drilling risk and also avoids multiple expensive casing strings of reduced diameters to be installed in the wellbore. Earth formations undergo geological changes which result in unexpected pressure and rock strength variations over millions of years. In order to reach complex, deepwater and unconventional reservoirs, the industry needs new ways to drill through multiple different pore pressure and fracture gradients in the same hole section. Today, no technology exists that can change the annular pressure and keep it within desired limits at multiple fixed points in the wellbore while continuously drilling in the wellbore. The industry is aware of a constant bottom hole pressure system which maintains a desired pressure equal to or above the mud hydrostatic pressure at one point near the bottom of wellbore by applying a positive back pressure from surface on the annulus side to compensate for equivalent circulating density (ECD) reduction when surface pumps are stopped. Such method and associated apparatus do not allow dynamic reduction in bottom hole pressure as any reduction requires altering the mud hydrostatic which is a slow process. They also do not prevent these changes from impacting the annular pressure profile in the rest of the wellbore and its consequent adverse affects on the well bore integrity or inviting formation influx. The industry is aware of a dual gradient system which establishes a fixed point between surface and bottom hole where a change of gradient can be achieved by either injecting $N_2$ using a parasitic string or a downhole pump. Not only is the capability of a dual gradient technique limited to just two gradients, the accuracy and precision in ensuring these gradients do not change during the course of drilling and completion is questionable due to many uncontrollable factors such as long open hole sections with compressible drilling fluids, lack of control on formation fluid influx, requirements to circulate continuously at all times and lack of downhole measurements all along the wellbore.

The present invention seeks to obtain all of the benefits of underbalanced drilling accompanied by all of the safeguards of conventional overbalanced drilling by controlling pressure adjacent the drill bit and bottom hole assembly and sealing and/or strengthening the formation while drilling. The present invention also seeks to overcome the shortcomings in current MPD practices by precisely controlling the annular pressure profile throughout the well bore. The invention also provides a unique solution to the industry for all the problems and costs associated with design, cleaning and maintaining drilling fluids. The present invention also provides the industry a solution to safely drill exploration wells underbalanced thereby increasing the chance of finding new productive zones previously overlooked by conventional OBD techniques.

The drilling industry has long sought a solution to these problems. For example, U.S. Pat. No. 5,873,420 discloses using a control valve adjacent the drill bit to release air into the mud mixture to lighten the hydrostatic head based upon sensed bottom hole pressure and other fluid measures. When open bottom hole pressure reached unsafe levels, the air supply would be reduced or eliminated thereby relying upon the column of dense drilling mud to control the formation pressure.

Similarly, U.S. Pat. No. 6,732,804 discloses a dynamic mudcap system utilizing concentric casings which allow a column of drilling mud to be maintained in a well bore annulus to control the well from blow out. The patent also discloses using a deployment valve to seal off bottom hole portions when the drill bit assembly is pulled for service or replacement. In neither prior art device is there any disclosure of means for open hole formation strengthening or preservation.

Prior art down hole plug arrangements intended to protect open hole underbalanced drilling, such as shown in U.S. Pat. Nos. 5,954,137 and 7,086,481, have required drill string manipulation to set and release the downhole plug.

SUMMARY OF INVENTION

The present application discloses a method for programmable pressure drilling comprising the steps of at least sealing an annular space creating a first pressure zone and a second pressure zone in a well bore; sensing pressure in both the first pressure zone and the second pressure zone; adjusting pressure between the first pressure zone and the second pressure zone to achieve a specific pressure gradient; and, drilling within the first pressure zone in the well bore while dynamically adjusting pressure in the first pressure zone. This method can further comprise the steps of strengthening the first pressure zone in the well bore while drilling; equalizing pressure in the first pressure zone with the pressure in the second pressure zone; and advancing the drilling in the first pressure zone, after equalizing, and sealing at a different point in a well bore.

This method can further comprise the step of hydraulically isolating the first pressure zone to prevent ingress or egress of drilling fluid or hydrocarbons from a sealed pressure zone. The step of strengthening can comprise one of the following selected methods for stabilizing the first pressure zone: coating the well bore with a sealant; deploying a sleeve, cementing a casing in place, expanding an expandable tubular, inserting and deploying an interlocking continuous strip, or gravel packing.

The method further can provide the step of continuously monitoring formation pressure and depth within the first pressure zone providing a streaming potential profile of the drilled well; or modulating pressure in the first pressure zone and measuring the streaming potential to determine formation pressure and permeability.

The method of this invention can further provide the step of continuously exciting the formation with sonic energy and measuring sonic velocity in the formation while modulating pressure in the first pressure zone thereby detecting formation characteristics without fracturing the first pressure zone; and/or, transmitting well information dynamically while drilling from the first pressure zone to the surface and receiving control signals back from the surface. This communication of well and formation information can be transmitted through wired drill pipe.

Moreover, this method additionally contemplates determining productivity potential of each pressure zone in the well as it is being drilled in the first pressure zone, thereby providing intimate well and formation information as the well is being drilled without the need for further surveying or study after drilling. Since the method contemplates instantaneous measurement while drilling, the method can further permit steering a drill bit within the first pressure zone utilizing information determined by a control unit communicating with one or more sensors located within the first pressure zone.

As may be appreciated this method for programmable pressure drilling of a well bore foresees disposing an annular seal proximal to a distal end of a drill pipe equipped with a bottom hole assembly, said annular seal allowing continuous movement of a drill pipe; engaging the annular seal with the well bore to form an alterable annular pressure in an annulus adjacent the bottom hole assembly below the seal in said well bore; drilling the well bore utilizing the bottom hole assembly while maintaining the annular seal; and, maintaining the well bore pressure on a distal side of the seal during the drilling of the bore at a pressure differential from a pressure on a proximal side of the seal. This method can further comprise removing drilling fluid and cuttings through said seal without releasing said seal, wherein the pressure in the open hole well bore is lower than the pressure in an annulus on an opposing side of the annular seal.

A method for controlling fluid pressure in a drilled well bore comprises establishing a moveable well bore seal between a drill pipe and a well bore face near a terminal end of a drill string; sensing a first fluid pressure at a well bore face and a second pressure in an annular space between the well bore and the drill string on an opposing side of the well bore seal; adjusting the pressure at the well bore face by pumping fluid from the well bore face through the well bore seal into the annular space while drilling; and, moving the well bore seal as drilling progresses at the well bore face.

The moveable seal can be made by energizing a tractor; or by moving a screw. This method can further comprise depositing a well bore seal on the well bore face. The well bore seal can be a sleeve; a sealing agent reacting with the well bore face, as it is compressively pushed against the well bore wall by either the tractor or the screw arrangement; an expandable casing which is expanded to engage the well bore wall; or an interlocking strip which is unfurled from a coil and would helically around the well bore wall face to engage the interlocking members and seal or strengthen the formation.

The programmable pressure drilling apparatus of the present disclosure comprises a drill assembly connectable to a distal end of a drill string; a first pressure sensor disposed proximally to the drill assembly; a seal selectably engaged to seal a distal end of the drill string from an annulus formed between said drill string and an adjacent circumferential wall, which seal moves with the forward progress of the drill assembly or remains fixed and allows for a tubular to slide through the seal as a sealed fluid return conduit; a second pressure sensor disposed on an opposing side of said seal for comparatively measuring the pressure differential between the distal end of the drill assembly and the annulus; and, at least one pump to remove fluid from an area adjacent the distal end of the drill assembly past the seal to the annulus.

The programmable gradient pressure drilling apparatus can further comprise a formation strengthening seal, wherein the seal is a sleeve, and the adjacent circumferential wall is either the well bore or a casing. The seal can be an interlocking helically wound coil.

The programmable gradient pressure drilling apparatus can further provide a proximal end of the sleeve which is latched to a casing prior to deployment against the formation, which can then be deployed in the open hole well bore to seal or strengthen the formation while drilling is completed. Because of the nature of the formation, this apparatus is designed to maintain the integrity of the productive formation by having the least impact of drilling fluid or cuttings. Accordingly, another feature of this disclosure is the preference for using a drilling apparatus having a reverse circulation center discharge drill bit and an underreamer, although a standard pilot hole drill bit could also be utilized in this drilling assembly.

DESCRIPTION OF THE DRAWINGS

FIG. 5 is a schematic view of an embodiment of the programmable pressure drilling system showing the positioning of a bottom hole assembly in a profiled latch disposed on the distal end of a tie back string.

FIG. 6 is a schematic view of the alternative embodiment being lowered to the latch on the distal end of a cased well.

FIG. 7 is a schematic view of the bottom hole assembly seated in the latch and hung off the tie-back string.

FIG. 8 is a schematic view of the bottom hole assembly awaiting the landing of the drill string to continue the drilling in the formation.

FIG. 9 is a schematic view of the latched drill string with the bottom hole assembly before unlatching the liner (tie back tube) to continue drilling.

FIG. 10 is a schematic view of the unlatched drill string and tie-back tube allowing drilling to proceed also showing the drilling fluid flow paths FIG. 11 is a schematic view of tie back string pulled back to latch in the casing to further allow the drill string and drill bit (along with other BHA not shown such as motor, LWD, downhole pump) to be tripped out of the hole FIG. 12 is a schematic view of the drill bit (as well as other BHA not shown such as motor, LWD, downhole pump etc) being pulled to surface while the through bore created due to their removal is shut off using a downhole valve located in BHA left in hole thereby maintaining a pressure seal.

FIG. 13 is a schematic view of the drill bit at total depth for the tie-back liner in preparation for the setting of the next casing string.

FIG. 14 is a schematic view of the drill bit (as well as other BHA not shown such as motor, LWD, downhole pump etc)

being pulled to surface after drilling is finished, while the through bore created due to their removal is shut off using a downhole valve located in BHA left in hole thereby maintaining a pressure seal.

FIGS. 15A-E are schematic diagrams of the method of practicing PGD programmable gradient drilling and completion of the present invention using moveable control and seal units.

Figure 16:
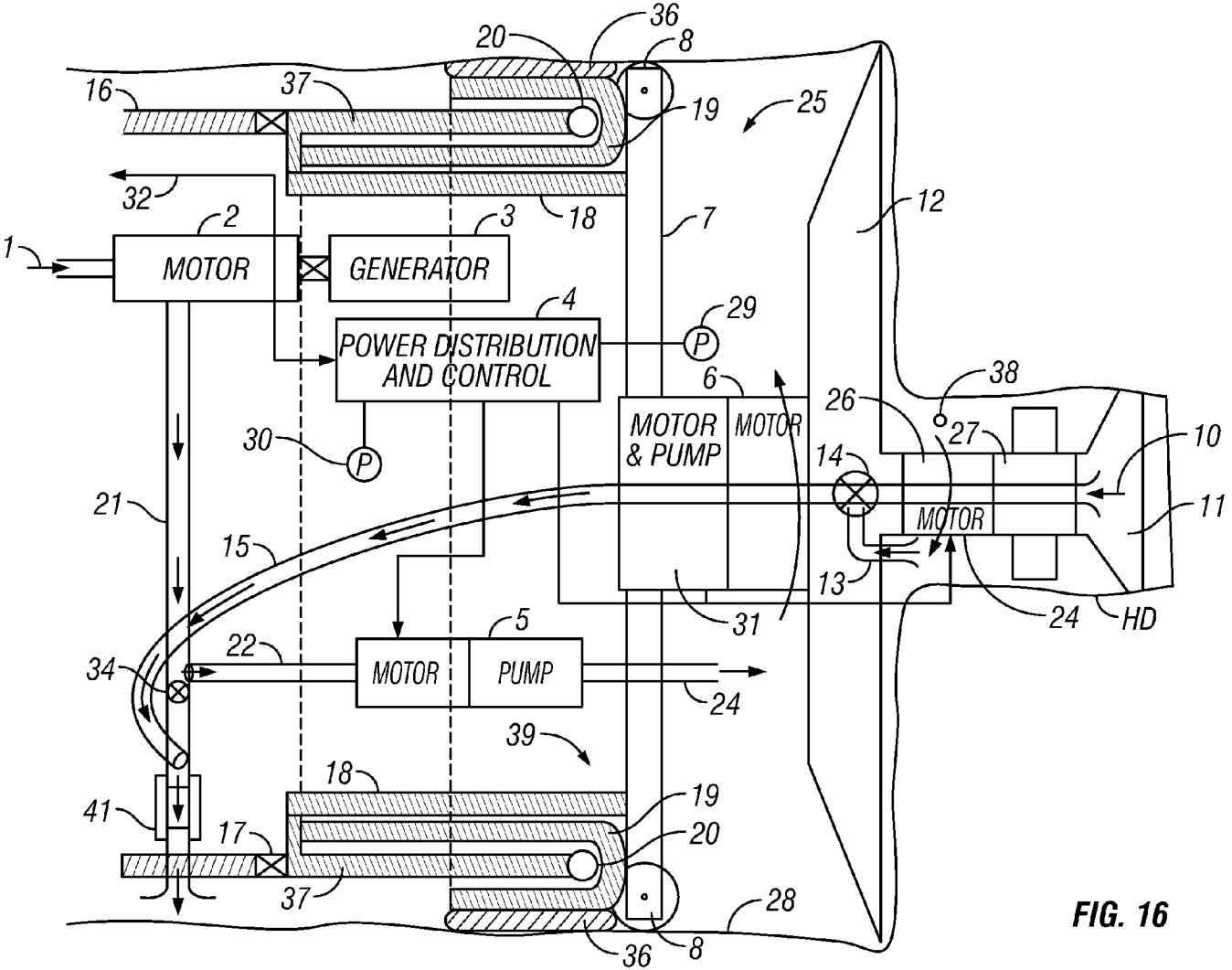

FIG. 16 is a schematic diagram of one embodiment of the apparatus for practicing the PGD programmable gradient drilling and completion of the present invention.

Figure 17:
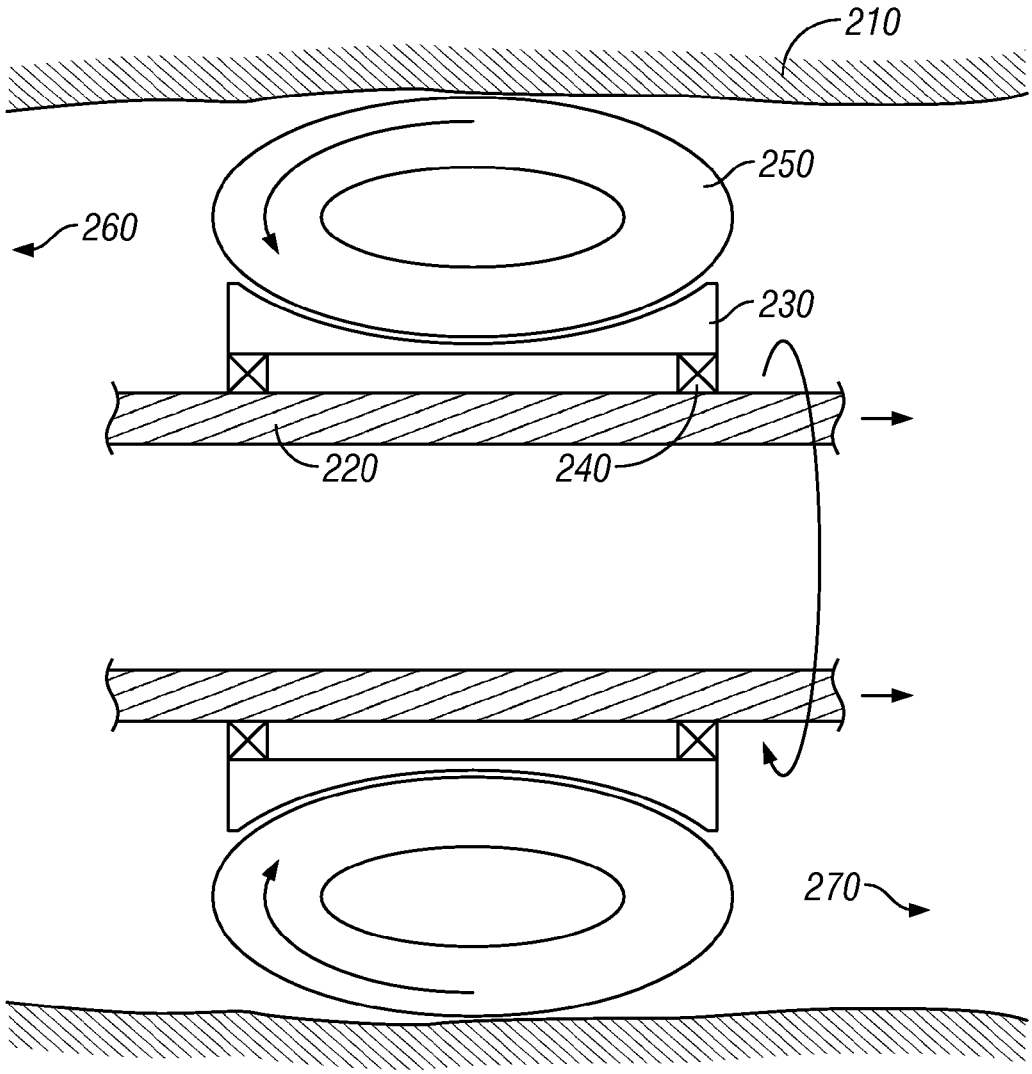

FIG. 17 is a schematic diagram of a tractor arrangement of the apparatus used in practicing the PGD programmable gradient drilling and completion.

Figure 18:
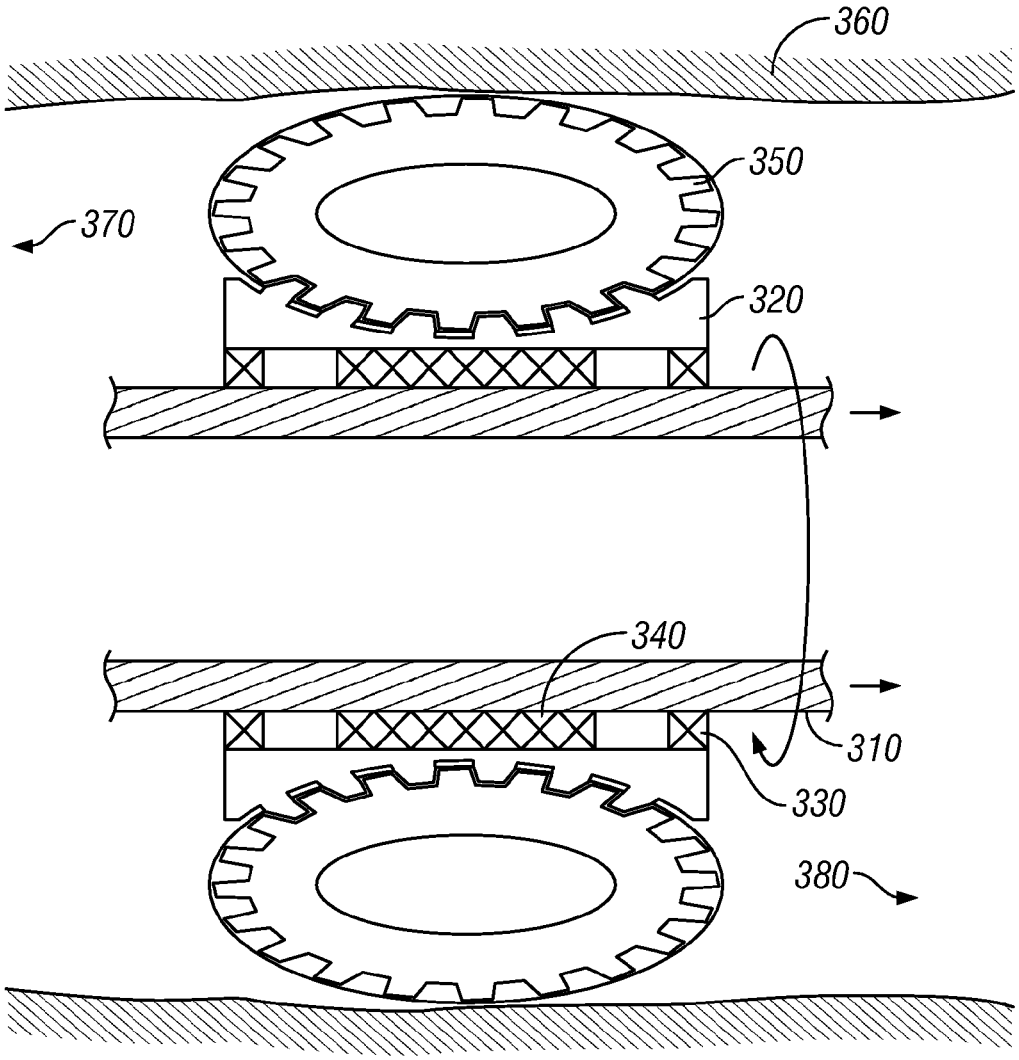

FIG. 18 is another embodiment of a tractor arrangement of the present invention.

Figure 19:
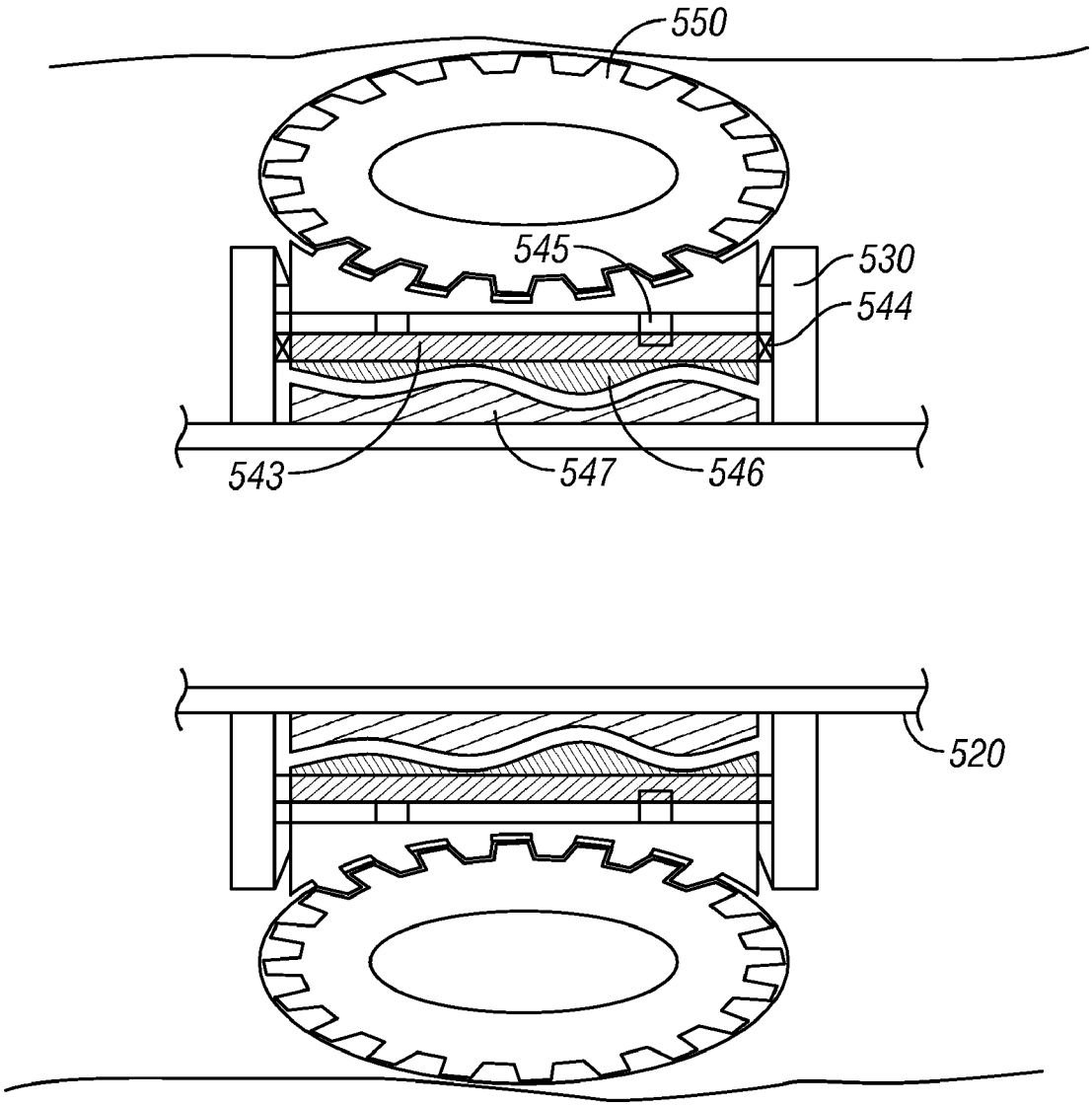

FIG. 19 is yet another view of an alternative embodiment wherein the tractor is driven by a mud motor.

Figure 20:
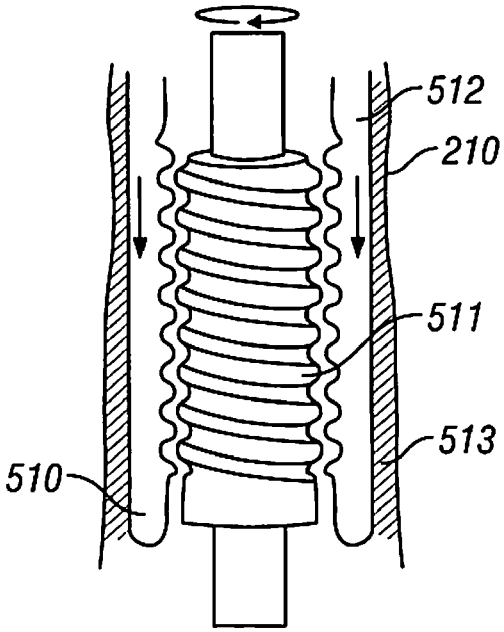

FIG. 20 is a schematic view of the expandable screw embodiment used in practicing the PGD programmable gradient drilling and completion of the present invention.

Figure 21A:
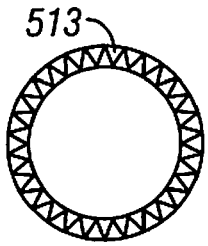
Figure 21B:
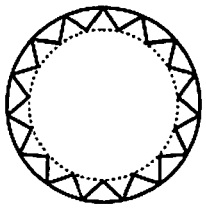
Figure 21C:
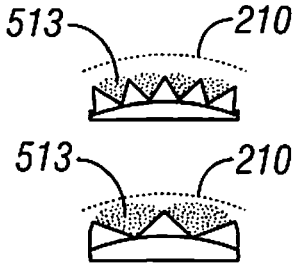

FIGS. 21A-C are analytical schematic views of the varieties of expandable screws which may be used to deposit a chemical sealing agent against a well bore wall.

Figure 22:
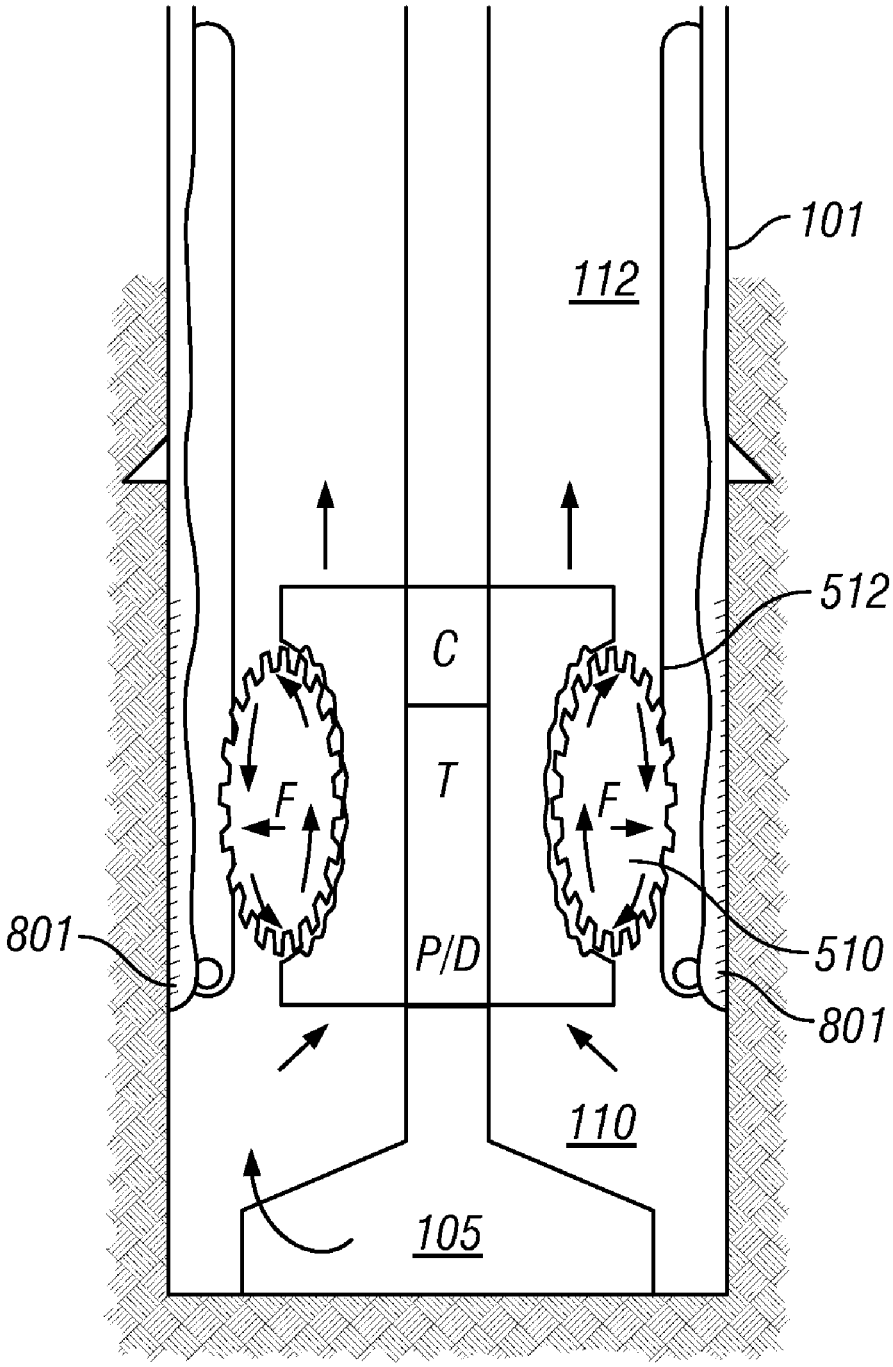

FIG. 22 is a schematic view of the tractor arrangement used in practicing the PGD programmable gradient drilling and completion aspects of the present invention.

FIGS. 23A-E are a sequential schematic view of one method for practicing the PGD programmable gradient drilling and completion aspects of the present invention.

Figure 24:
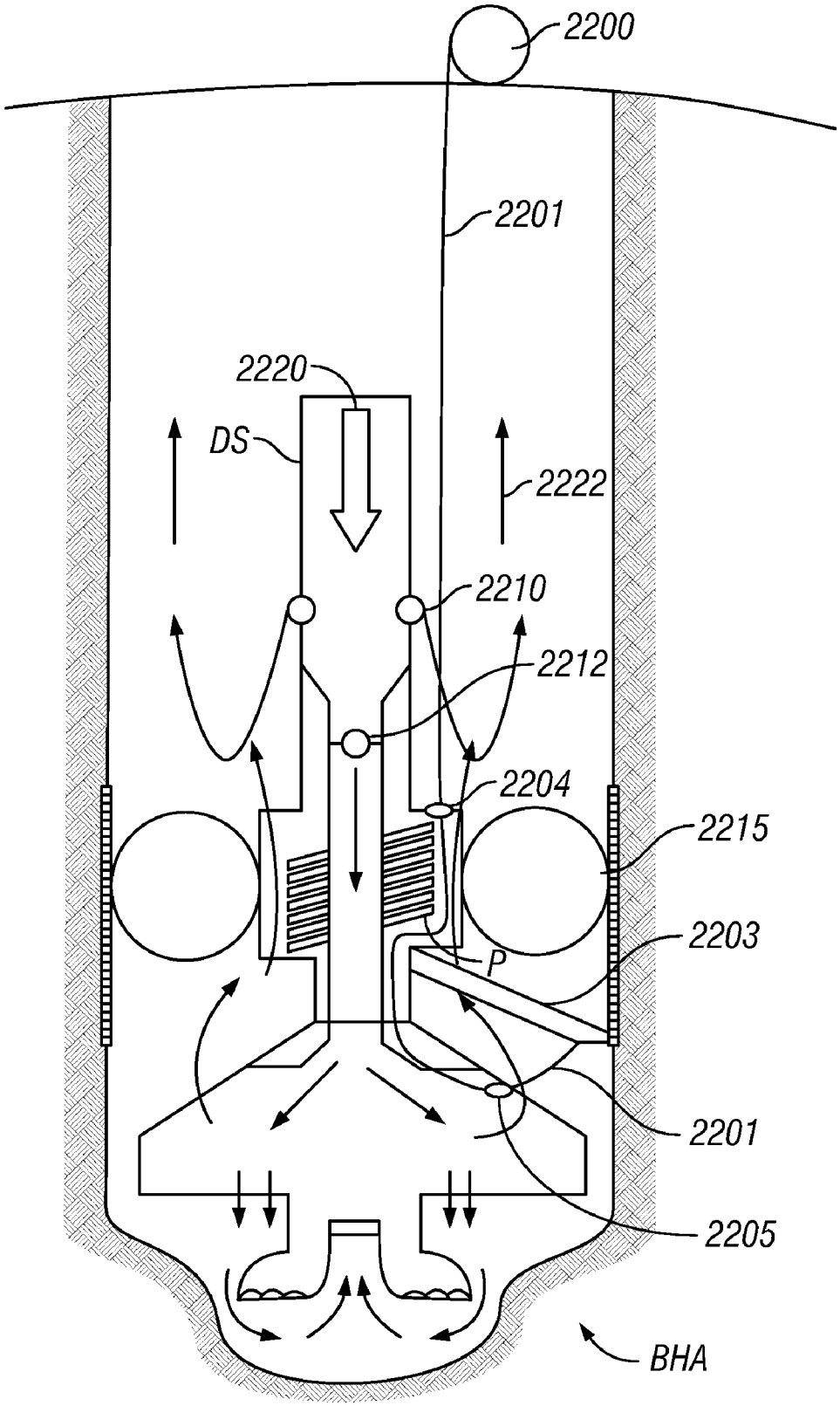

FIG. 24 is a schematic view of the interlocking strip deployment drilling assembly used in practicing the PGD programmable gradient drilling and completion aspects of the present invention.

DESCRIPTION OF AN EMBODIMENT

Figure 1:
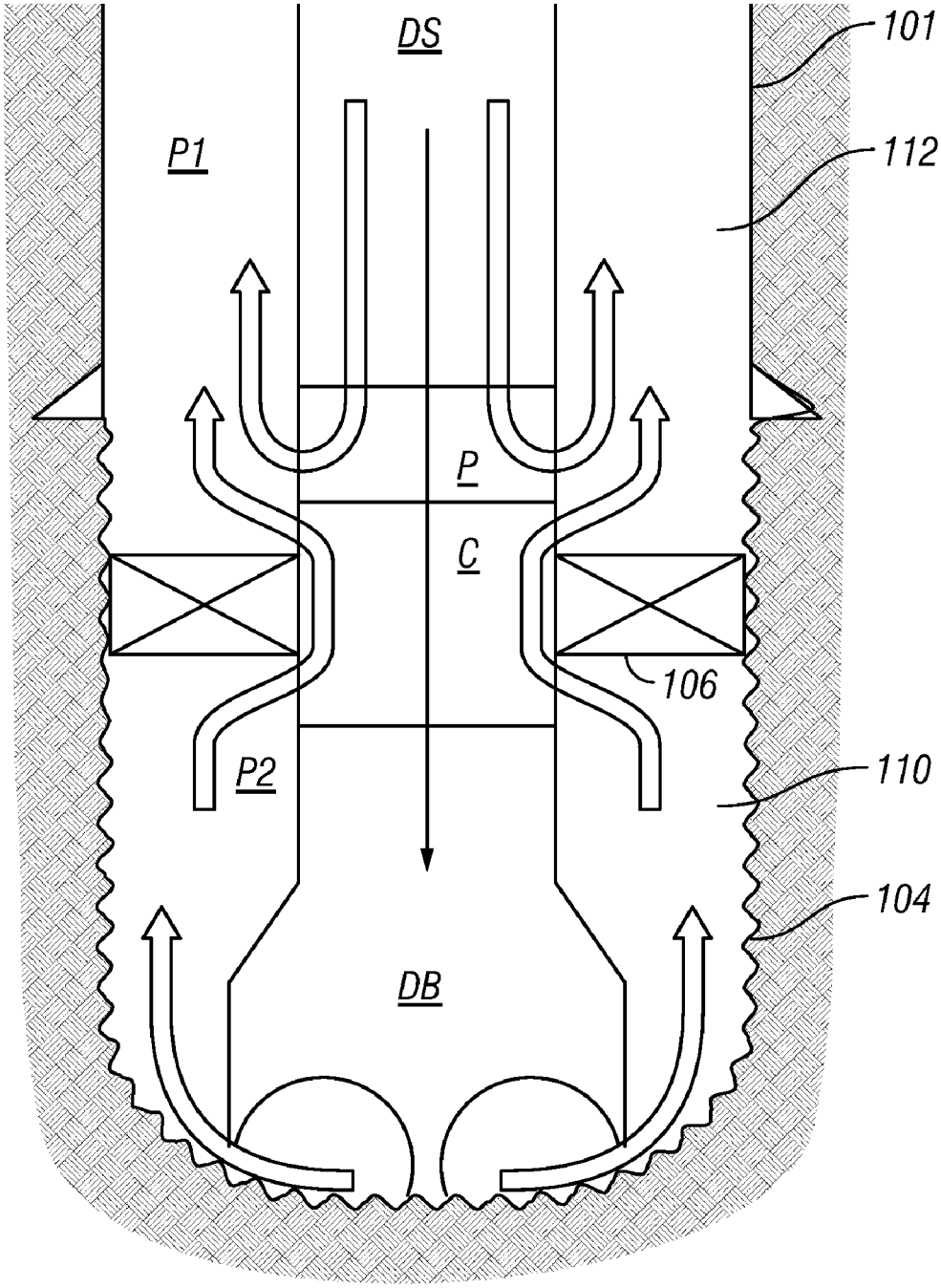
FIGS. 1 and 2 are each a schematic diagram of a method of practicing programmable pressure drilling.
Figure 2:
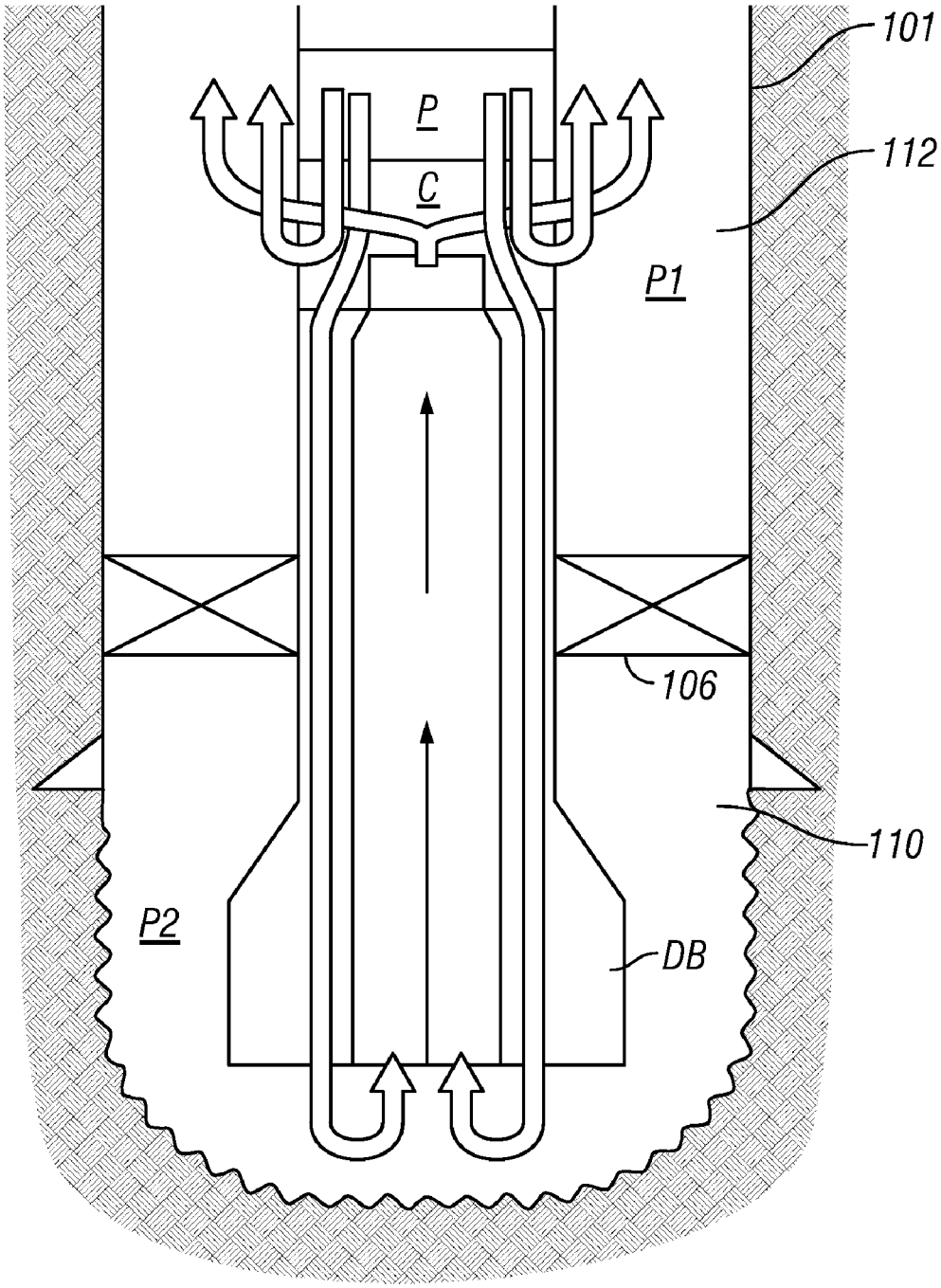

FIGS. 1 and 2 are schematic diagrams of a method of practicing programmable pressure drilling using a moveable control unit C located inside a drilling assembly and a seal unit 106 forming an annular seal around the drilling assembly against either an adjacent casing or an adjacent well bore wall. Control unit C disclosed provides sensing and measurement and can communicate with and be controlled by electromagnetic signal, mud pulse telemetry by wired casing or any other method well known in the down hole measurement and control art. Seal unit 106 can either be fixed, but moveable, or a moving dynamic seal. If fixed, the seal unit 106 allows the movement of the drilling assembly through the seal 106. If dynamic, the seal unit 106 moves with the movement of the drilling assembly to maintain the seal of the pressure zone and to deploy, in the programmable gradient drilling (PGD) context a formation stabilizing or sealing material on the well bore wall. This feature will be further discussed below.

Control unit C also controls the flow of fluid into and out of the programmable pressure zone 110 by a choke/pump system, in coordination with the pump pressure in the drill string. For example, if the programmable pressure zone required lowering of pressure to avoid overbalancing the drilling, control unit C would choke off fluid from reaching the drill bit or increase the rate of flow out of the programmable pressure zone 110, or both, to achieve a desired pressure in the programmable pressure zone. Measurements, such as streaming potential, could be employed to discern the desired pressure to be maintained in the programmable zone while drilling if such desired pressure is not known initially using other reservoir characterization and modeling techniques.

A pump P, proximally located with control unit C can move drilling fluid from the programmable pressure drilling zone 110 to the annulus 112 just above the annular seal 106 where the drilling fluid and cuttings are lifted to the surface in a normal manner. This pump P coordinates with the choke/diversion valves of the control unit C to divert a first portion of total drilling fluid flow from surface inside the drill string DS to the annulus 112 outside the drill string DS just above the annular seal 106, the volume percentage of which is determined by the hydraulic energy needed to create sufficient annular velocity to lift all the cuttings back to the surface as already known to those experienced in the art of drilling. Pump P programmatically control the flow of a second portion of drilling fluid into and out of the programmable pressure drilling zone. The total volume percentage of this second portion is determined by the flow needed to provide cooling to the bit while also delivering enough hydraulic energy needed by the bit to drill as known to those experienced in the art, while the programming of flow, one of the purposes of this invention, is performed by pump P to maintain the programmable drilling zone pressure at the optimal pressure to protect the formation, for instance, to protect the formation from excessive hydraulic pressure.

Flow from the surface pumps can be diverted to recirculate through the annulus at the direction of the control unit C to reduce the flow into the programmable pressure zone. Sensed pressure in the programmable pressure zone is further managed by the pump P controlled by and adjacent the control unit C which also removes drilling mud and cuttings from the PPD zone. The pump P is driven by a downhole power source, such as a hydraulic motor (not shown) to avoid the need to provide power from the surface. Existing technology such as electrical service provided by cable from the surface can also be utilized without departing from the spirit of this application. A standard mud motor, used by the bottom hole drilling assembly, can also be used to drive the pump P.

Although a standard flow drill bit is schematically shown in FIG. 1, as shown in FIG. 2, a RCCD drill bit arrangement can preferably be used to further minimize drilling fluid influx into the programmable drilling zone, yet sufficient to clear cuttings from the well bore in said pressure zone. Drilling fluid flow required to sufficiently cool the bit and lift the cuttings through the control unit C, pump P and valve arrangement is expected to be significantly less than the drilling fluid normally used in overbalanced drilling operations.

Using a mud motor allows approximate matching of rotation speed of the mud motor and the pump P, thereby avoiding the need for a gear box. A transmission (wobble joint) is expected to be most likely arrangement to account for a different number of lobes on the motor and pump. The progressive cavity pump provides superior performance over a centrifugal pump in abrasive applications. Both the motor and the pump will be formed with hollow shafts. For the motor, this will allow only the necessary amount of flow for powering the pump to be passed through the motor. For the pump, this shaft will provide the drilling fluid allowed past the drill bit to bypass the pump itself.

To perform Programmable Gradient Drilling (PGD), control unit C activates seal unit 106 to deploy a sealant such as an intelligent mud cake or a mechanical barrier such as a sleeve as more fully described herein. Alternative embodiments could provide an expandable packer, an expandable casing system which is deployed by a swage against the interior wall of the packer, or any other form of bore hole stabilization currently available in this art.

Finally, once the zone has been drilled and strengthened or stabilized, the control unit C can permit the equalization of pressure in the overbalanced zone 112 with the underbalanced zone 110 and release the seal for further operations in the well bore. Alternatively, the method can provide for zone isolation of the stabilized zone by setting external packers, all in a manner well known in the drilling industry. This process can be repeated as often as necessary to preserve the integrity of the well bore, while detecting likely zones for completion and perforation. Since drilling does not occur in an overbalanced condition in these zones and the formation remains unclogged with high pressure drilling mud cake, expensive and time consuming well preparation does not have be undertaken to commence production.

Additionally, the use of the present technique is optimized by continuous drilling ahead with reduced drilling fluid flow into the PPD zone and thus depends upon the successful deployment of drill bit assemblies that are low torque, high rate of penetration bits, providing maximal hydraulic horsepower per square inch of bit area (HSI). It is expected that flow rates of approximately 150 gallons per minute would be sufficient to provide the hydraulic power for the mud motors and still retain a high rate of penetration of the bit. Low torque bits, such as the nutating drill bit found in U.S. Pat. No. 6,892,898, could be used in this application. Other existing conventional drill bit designs, well known to those in this industry, could be substituted without departing from the spirit or scope of this invention. The use of RCCD bit technologies is highly desirable to avoid contact of the drilling mud with the PPD zone well bore wall.

Figure 3:
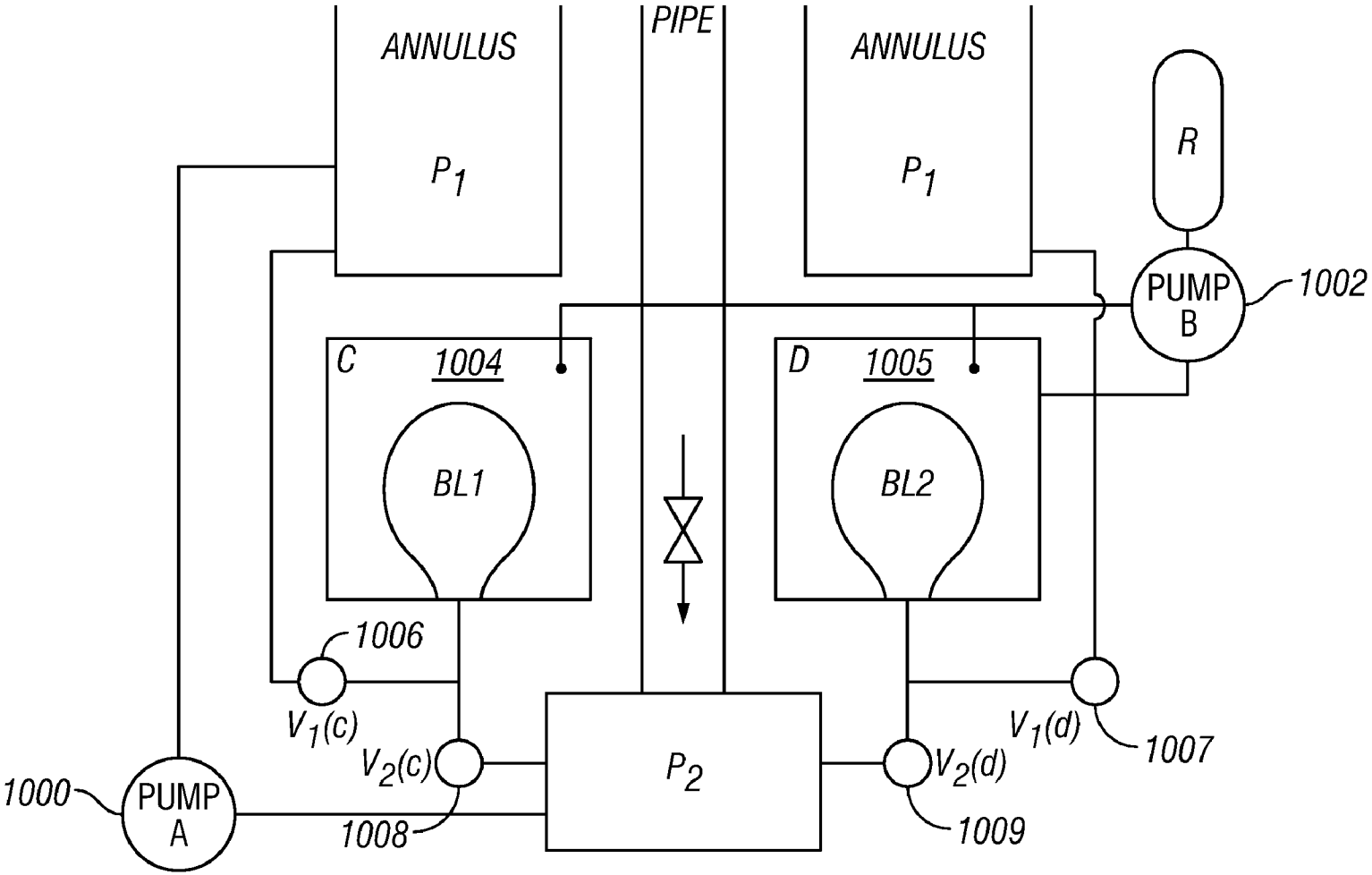
FIG. 3 is a schematic view of a pump utilizing coordinated bladders located inside the movable control unit to manage annular pressure differentials.

FIG. 3 shows a schematic diagram of another embodiment providing coordinated bladder pair BL1 and BL2 which are inflated or deflated from the pressure differential between the programmable pressure P2 in the PPD zone and the annulus pressure P1 above the seal of the pressure zone through the mediating adjustment of a flow rate of pump 1000. Pump 1002 moves hydraulic fluid from reservoir R to the enclosed chambers C and D to alternately move drilling fluid and cuttings from the programmable pressure zone into the annulus, while the expanding alternate chamber and bladder absorbing fluid and cuttings and thereby maintaining the pressure in the programmable pressure zone at P2. This further provides the additional benefit of preventing a pressure shock wave from movement of fluid into and out of the PPD zone. Valve arrangements shown as 1006 V1(C) and 1008 V2(C) connected to chamber 1004, and valve arrangements 1007 V1(D) and 1009 V2(D) connected to chamber 1005, on each coordinated bladder, are controlled by the control unit C as shown in FIG. 1 and previously discussed move fluid into and out of programmable pressure zone and into the annulus having pressure P1.

The coordination of the two bladders of FIG. 3 can also be accomplished by other means without departing from the spirit or intent of this disclosure. For example, a bladder could be inserted into a vacuum chamber which would move the bladder into full inflation. A mechanical net or device would be placed around the bladder and upon signal from the control unit C would pull in the net to contract the bladder thereby emptying the bladder of the drilling fluid and cuttings which it had been drawn into the expanding chamber in the programmable pressure zone. Valving arrangements would again regulate the movement of drilling fluid and cuttings into and out the bladder to avoid pressure wave shocks to the managed pressure zone and maintain the drilling zone pressure below the natural pore pressure adjacent the device.

Figure 4:
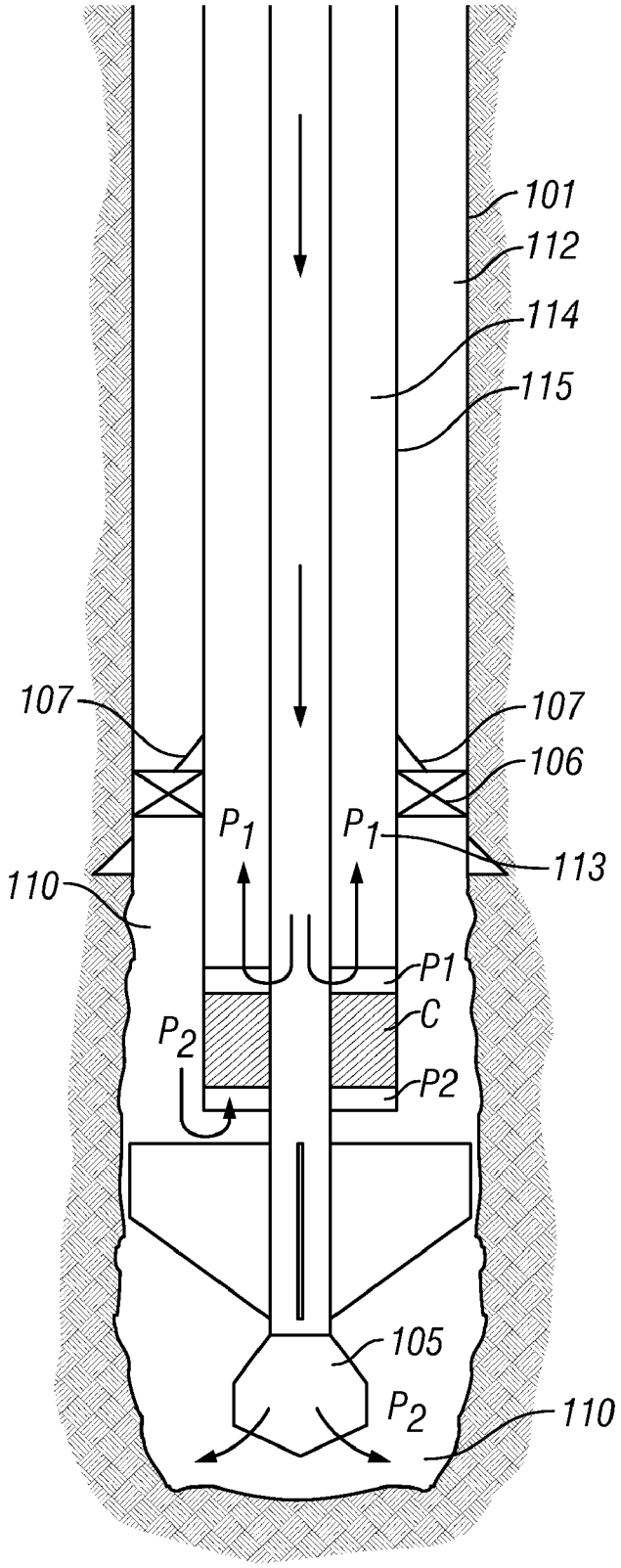
FIG. 4 is a schematic diagram of a method of practicing programmable pressure drilling (PPD) by using a non-movable sealing unit stationed within a casing, providing a secondary return conduit through which to control the pressure using a movable control unit close to the bit.

FIG. 4 is a schematic diagram of a method of practicing PPD programmable pressure drilling and completion by using a non-movable sealing unit 106 stationed within a casing, providing a secondary return conduit by which the pressure using a movable control unit close to the bit is controlled. Drill string 114 and the secondary return conduit 115 are mechanically coupled together using a special latch which allows drill string 114 to rotate with respect to secondary return conduit 115 and the secondary return conduit 115 to slip through the seal unit 106, either using the weight of the drilling assembly or by the push force applied to drill string DS using the top drive at the surface, thereby permitting further movement of the drill assembly and bit 105. Dynamic or sliding seals 107 maintain isolation and also prevent ingress of annular drilling mud in the annulus 112 into the PPD zone 110.

A pressure zone 110 is created by isolating below sliding seals 107 which permit a casing 115 to enclose a drill string 114 creating a centralized annular space 113 between the outer wall of the drill string 114 and the inner wall of the casing 115, thus permitting the removal of drilling fluid and cuttings moved into the annulus 113 by control unit C in the manner discussed above. Programmable pressure drilling is therefore achieved whereby the pressure at the bottom of the open hole region 110 is maintained at pressure P2 while the pressure just above the control unit C inside the annulus 113 is typically higher pressure P1, thereby resulting in a single yet easily alterable gradient along the entire open hole in which to further case and complete the well.

Figure 5:
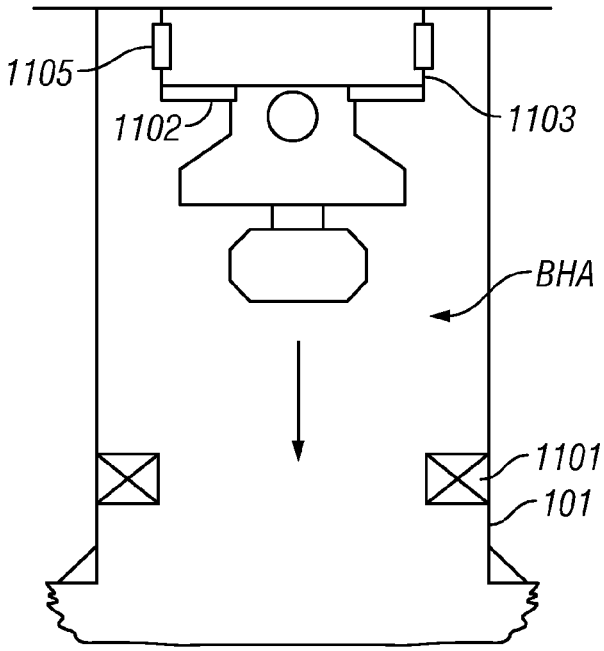
FIGS. 5-14 are sequential schematic views of one method for practicing the PPD programmable pressure drilling and completion aspects of the present invention.

As more fully shown in FIG. 5 et seq., another alternative technique for accomplishing programmable pressure drilling is disclosed derived from the methods described above. A liner 1103 with a bottom hole assembly (BHA), including the underreamer and bit already made up at its distal end can be run in hole and hung off below the surface using a liner hanger set in previous casing operations. Drill bit is such that it can be retrieved through the underreamer in manner known to those skilled in the art. BHA includes control unit C and seal unit for programmable pressure/gradient drilling as already explained in earlier descriptions and additionally, logging while drilling (LWD) and rotary steerable systems (RSS) (all of which are well known in the art and not shown in full detail here). A mechanical seal at an external surface of the distal end of the liner, once set in place in the previous casing, could disengage itself from liner and allow the liner to slide through an inner seal of the outer mechanical seal while maintaining a pressure difference across the seal, i.e. as a downhole stripping BOP.

Figure 8:
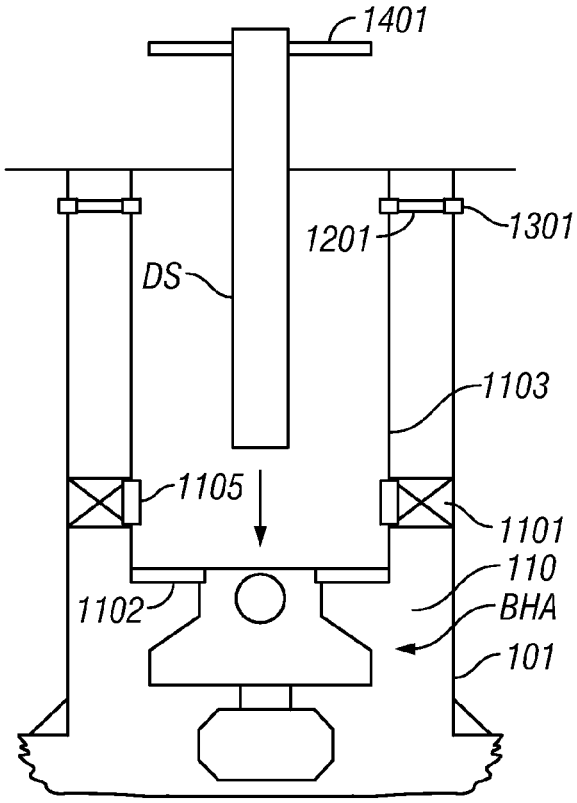

Then a drill string DS, as shown in FIG. 8, can then be run inside the liner and latched with BHA at the bottom thereby simultaneously releasing the BHA from the liner and allowing the drill string DS to transmit torque and weight to BHA. The liner can then be released from liner hanger and latched to drill pipe using a rotating latch arrangement; for instance, that allows the drill pipe and BHA to rotate relative to the liner. The liner would then hang from drill pipe providing a means for moving and resetting the liner and providing a second return conduit. No drilling torque or weight on bit (WOB) is transmitted to the liner by the drill string DS or the BHA.

After drilling to total depth in a different pressure environment, the liner can be set in place and cemented and drill pipe retrieved. A liner could be an expandable steel type or a flexible tube structure pre-loaded with chemicals to provide a temporary isolation and later replaced with one steel casing.

More specifically, as shown in FIGS. 5-14, the methods of the present invention can be used to both drilling in a programmable manner and cement the open hole upon completion of the drilling. This alternative method, as shown in FIG. 5, entails providing a landing profile 1101 in the distal end of casing string 101. The bottom hole assembly BHA is made up or engaged on the distal end of a tie-back or tubing 1103 which could be a casing, an expandable tubular member or flexible conduit having sufficient strength to support the BHA and maintain a seal at the pressures which are experienced by tools in this type of drilling service. The BHA, at a minimum, is made up of a bit, an under-reamer and the pump and control unit previously discussed herein which are used to sense and maintain the open hole pressure at a pressure differential from the annulus pressure, if required. The pump is hydraulic, driven by the flow of mud from the surface. The tie-back tube 1103 is additionally provided with a latching surface 1105 which is capable of selectively latching and unlatching with latch profile 1101 on the tie-back tubing 1103.

Figure 6:
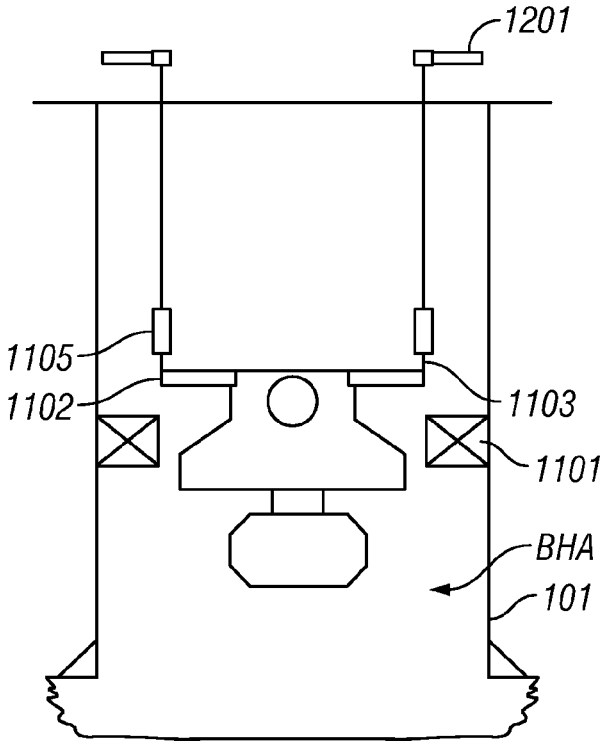

As more fully shown in FIG. 6, the tie-back tubing 1103 is lowered into the well using standard drilling operations to the distal end of the casing string 101 at which time a liner hanger or tubing hanger 1201 is attached to the proximal end of the tie-back tubing 1103. This liner hanger or tubing hanger can be either at the wellhead at the surface or downhole in the previously set casing. Each of these operations is well known in the drilling industry and is readily accomplished by drillers having ordinary skill in this art.

Figure 7:
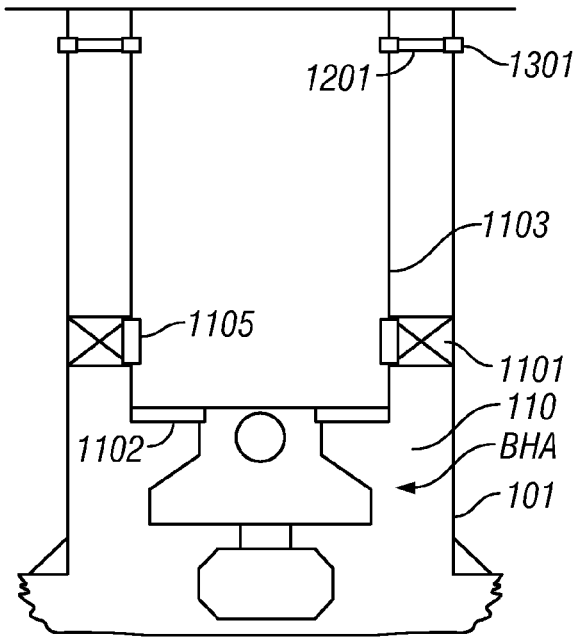
Figure 9:
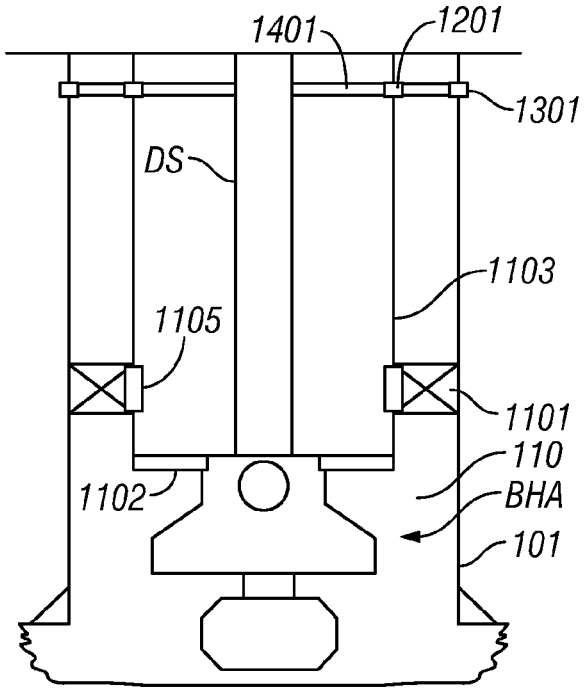
Figure 10:
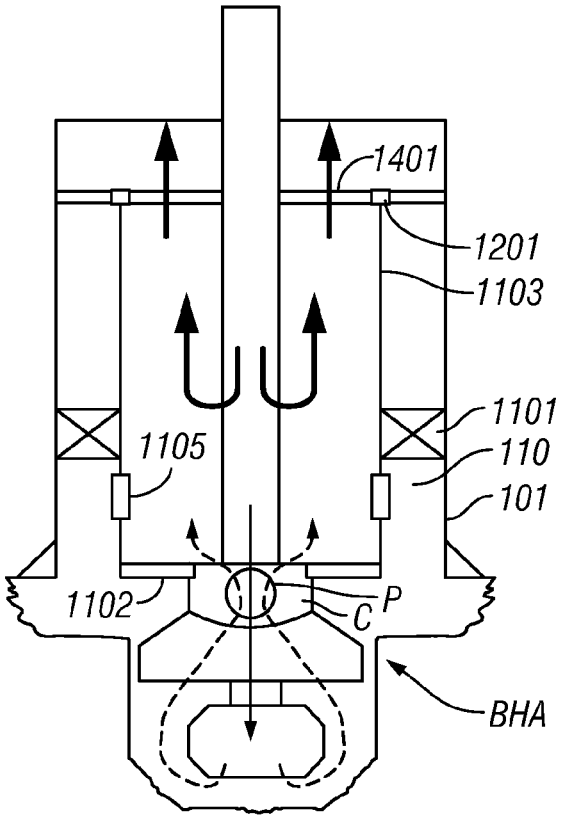
Figure 11:
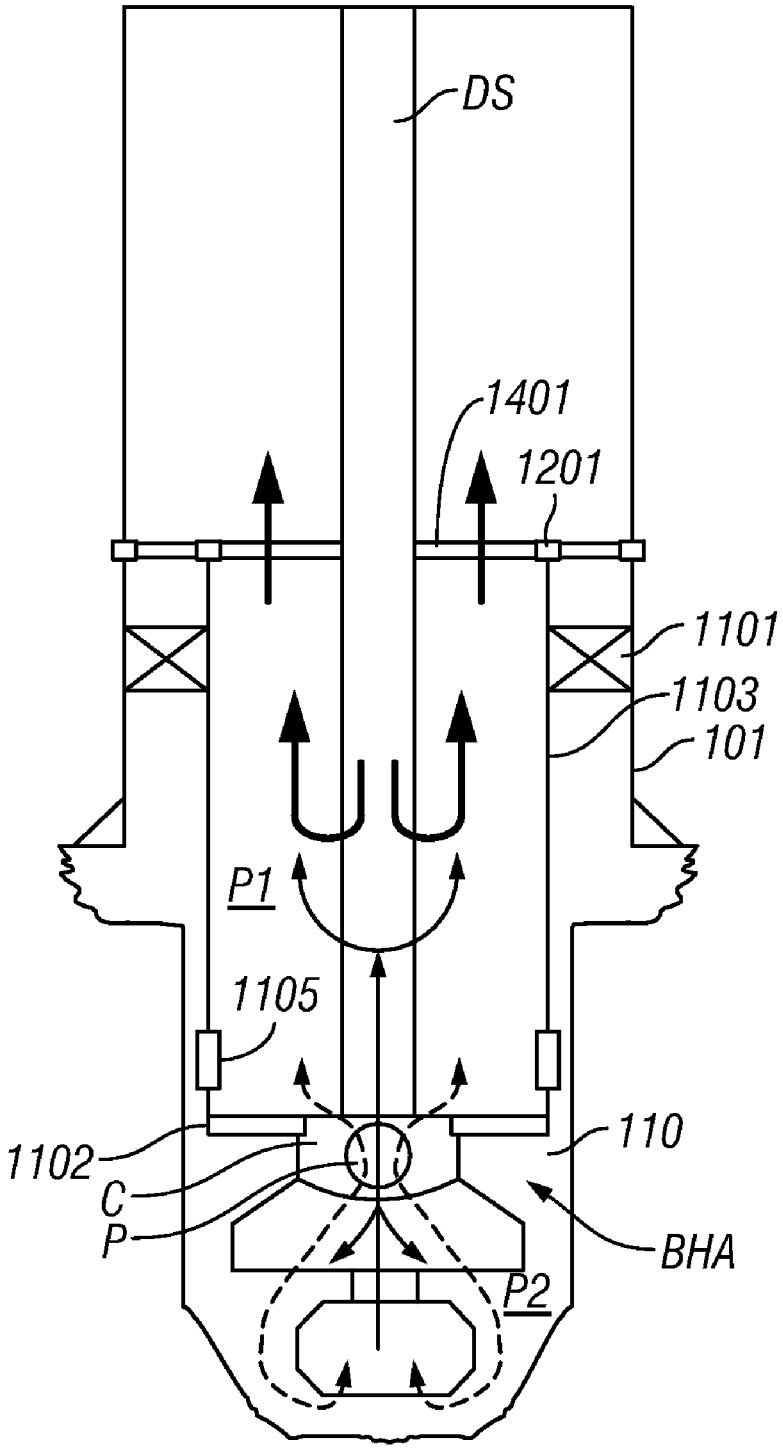

As shown in FIG. 7, the tie-back tubing 1103 is lowered into engagement of the latching surface 1105 with latch profile 1101 in the distal end of the casing 101. This latching can be accomplished by either mechanical or hydraulic means, but once established the seal prevents fluid communication from the open hole below the casing 101 and the annulus between the tie-back tubing 1103 and the casing 101. Once the tie-back tubing 1103 is hung off at the top 1201, 1301 and the casing seal latch is accomplished 1101, 1105, as shown in FIG. 8, a drill string DS providing a distal end capable of mating with the BHA and an upper end providing a hang-off profile 1401 is lowered to engage the BHA. As shown in FIG. 9, once the drill string DS latches into BHA, BHA is simultaneously released from the liner allowing the drill string DS to transmit torque and weight to BHA independent of the liner. Further, the upper hang-off profile 1401 engages the tie-back tubing mating latch surface 1201, the drill string DS is thus latched and supported at the top of the tie-back tubing 1103.

The tie-back tubing 1103 is then released from the casing latch 1101 by releasing the latch 1105 so the drill string DS supports the tie-back tubing 1103 and the BHA. The seal is maintained in casing seal 1101 to prevent fluid communication, yet permits the tie-back tubing 1103 to advance into the well with the bottom hole assembly BHA as drilling progresses. As more fully shown in FIG. 10, drilling fluid is circulated down the drill string DS to the control unit and diversion valve in the pump/control unit body which permits low pressure fluid to be used in the open hole to cool the bit and flush the cuttings from the bit face. This method has been previously described herein and the flow of fluid represented by arrows shows the movement of drilling fluid through the assembly schematically only. More specifically in context of present embodiment, control unit C once activated forms an annular seal 1102 with the tie-back tubing 1103 such that the annulus that is created by disengaging BHA from tie back tubing 1103 and latching to the drill string DS is simultaneously sealed off to maintain a pressure barrier across the programmable pressure zone 110. Seal 1102 can be a packer which is non-load transmitting and non-load bearing to prevent drilling forces from acting on the return conduit. The two steps are conducted such that prevents unwanted equalization of pressures especially when removing drill string DS from hole.

BHA will preferably be outfitted with a reverse circulation bit (RCCD) so the drilling fluid which is diverted from the annulus will exhibit a substantially lower flow rate than the drilling fluid moved from the surface to the control unit/pump connected to the distal end of the tie-back tubing, while allowing the pump, which is integral to the programmable control unit, removes cuttings and fluid from the bore hole face. See FIG. 2 for more details of the flow characteristics of the reverse circulation bit. The cuttings are immediately moved to the area adjacent the annulus side of the seal for rapid removal to the surface with the flow of drilling fluid being diverted from the programmable drilling zone.

Figure 12:
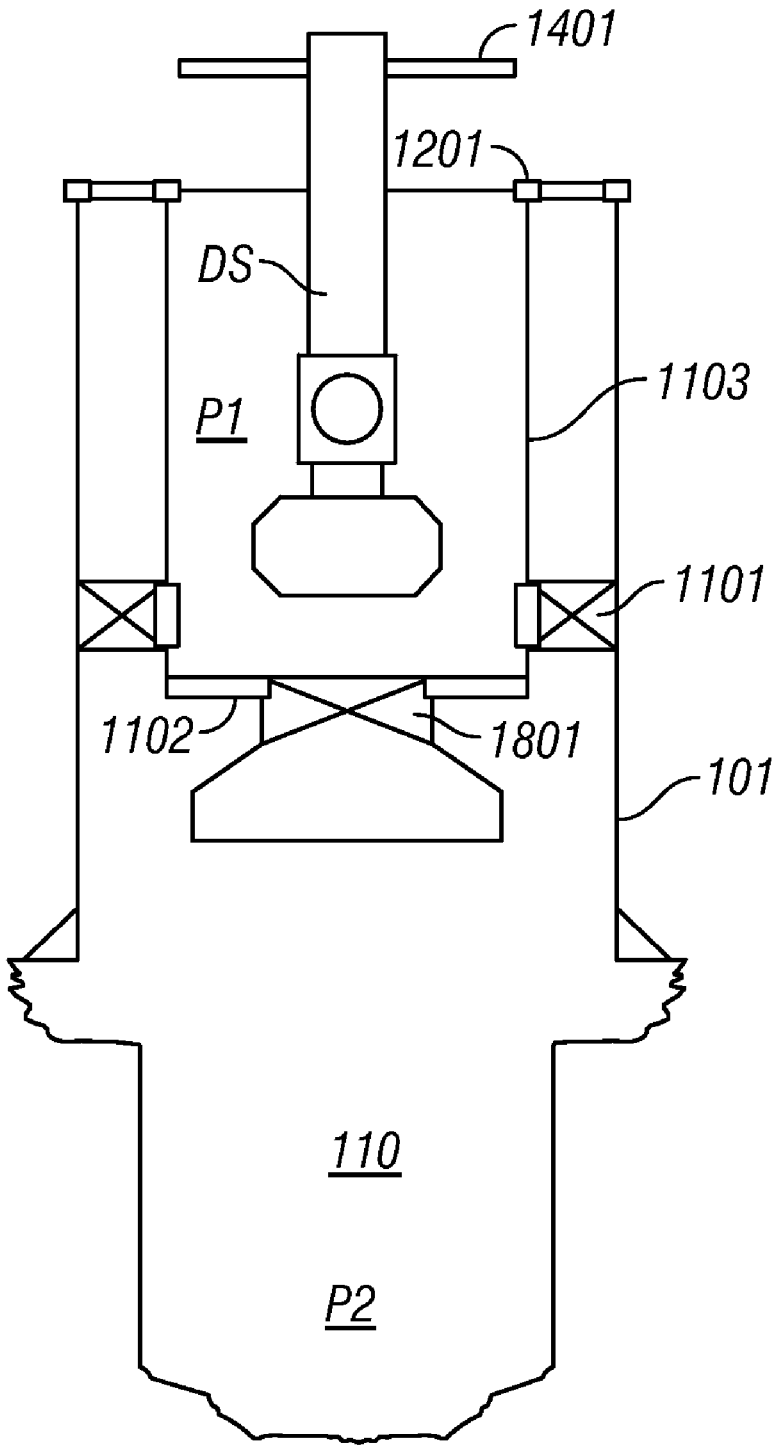

As noted, the hang-off profile 1401 is mechanical only and permits drilling fluid with cuttings to be returned to the surface. As the tie back tubing moves into the open well, as more clearly shown in FIG. 12, this hang-off profile 1401 moves adjacent the seal 1101. Once these are adjacent, another casing string must be inserted into the well to continue drilling, if desired. If the total depth of the particular zone has been achieved, the drill string DS is pulled back to engage latches 1401, 1201 and 1105, 1101, to prepare to move the BHA out of the hole. The configuration returns to the position shown in FIG. 9 where BHA latches back into tie-back tubing 1103 thereby closing the annulus mechanically and then the Control unit C is deactivated to release the seal 1102. Thus, as shown in FIG. 12, the drill string DS is removed from the BHA and a valve 1801 is closed in the BHA as the drill string is withdrawn. The completed portion of the open hole drilled is thus shut in while this operation is completed. If the tubing used is metal casing, normal cementing operations can be undertaken to set the existing casing in the well bore. If the tubing is expandable casing, the removal step described above could also consist of moving an expanding mandrel or swage through the casing to set it in the well bore. If the tubing is flexible conduit, the well could be completed or the conduit could be expanded to support the lateral well bore walls in the open hole. Each of these completion techniques are standard operations and well known to those in this industry.

As previously explained above, in order to commence drilling with the assembled unit, drilling fluid is circulated through the system. The pump and valving arrangements within the BHA reduce the fluid pressure experienced from the flow of drilling fluids in the system to minimize any abnormal pressure on the open hole. The hydraulic seal 1101 in combination with an energized seal in control unit C 1102 maintains this pressure difference even while the tie-back tube 1103 and BHA are drilling forward. This seal therefore acts like a downhole stripping blow-out preventer, allowing the tie-back 1103 to slip through while maintaining the seal around the tube. This seal need not be rubber and metal-to-metal seals could be used because the tube is non-load bearing and need not have any specialized tool joint surfaces. The tie-back tube 1103 only acts as a conduit to provide a means for sealing the annulus pressure from the open hole pressure.

The exact flow of drilling fluid can be accomplished by standard drill bit techniques running at lower operating pressures, or can be accomplished using reverse circulation drill bits to minimize the pressure build up at the bit face while maximizing the cuttings removal, all in a manner well known in the drilling industry. Reverse circulation drill bits permit the movement of drilling fluid and cuttings into the central portion of the drill string without excessive disturbance of the well bore wall in the open hole. In the present embodiment, these cuttings and drilling fluid would only be required to be lifted a relatively short distance where they would be mixed with the full pressure circulation above the seal of the regular drilling fluid return system.

Figure 13:
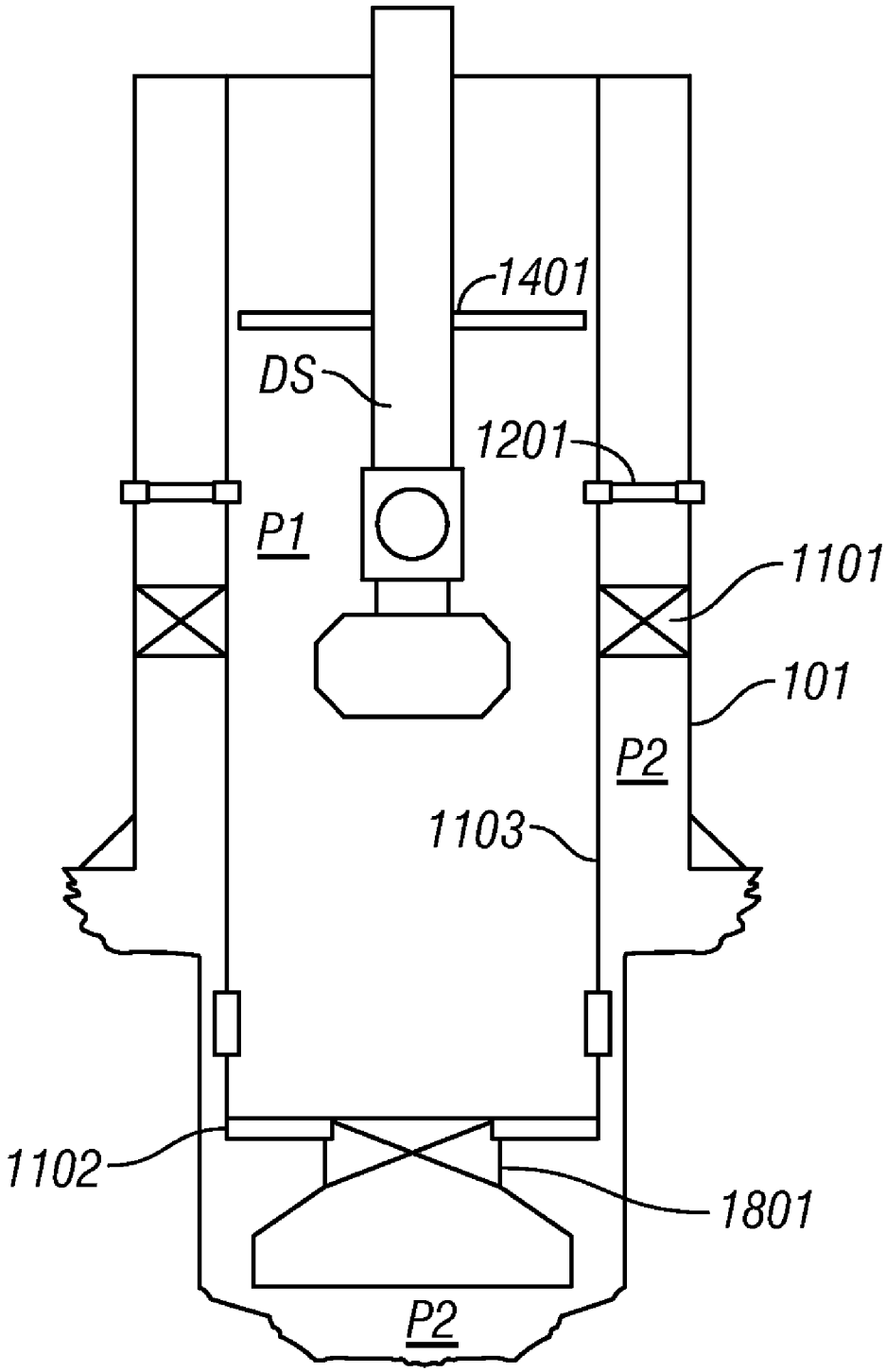

If a bit trip is needed without the need to replace the existing tie-back or liner hanger 1103, as shown in FIG. 12, for example to replace the bit assembly, the drill pipe and liner can be pulled out of the hole, past a downhole safety valve 1801 to the last latching point, liner 1103 hung off as usual, allowing the downhole valve 1801 to close as the BHA passes it, thereby keeping the drilling zone pressure P2 preserved, while allowing the drill string DS to be pulled from hole with the bit and other BHA components. Since the seal 1101 and valve 1801 will hold, at least temporarily for a bit trip, the pressure zone pressure P2, as shown in FIG. 13, the bit trip can be accomplished without withdrawing the tie-back to a prior latching point.

Figure 14:
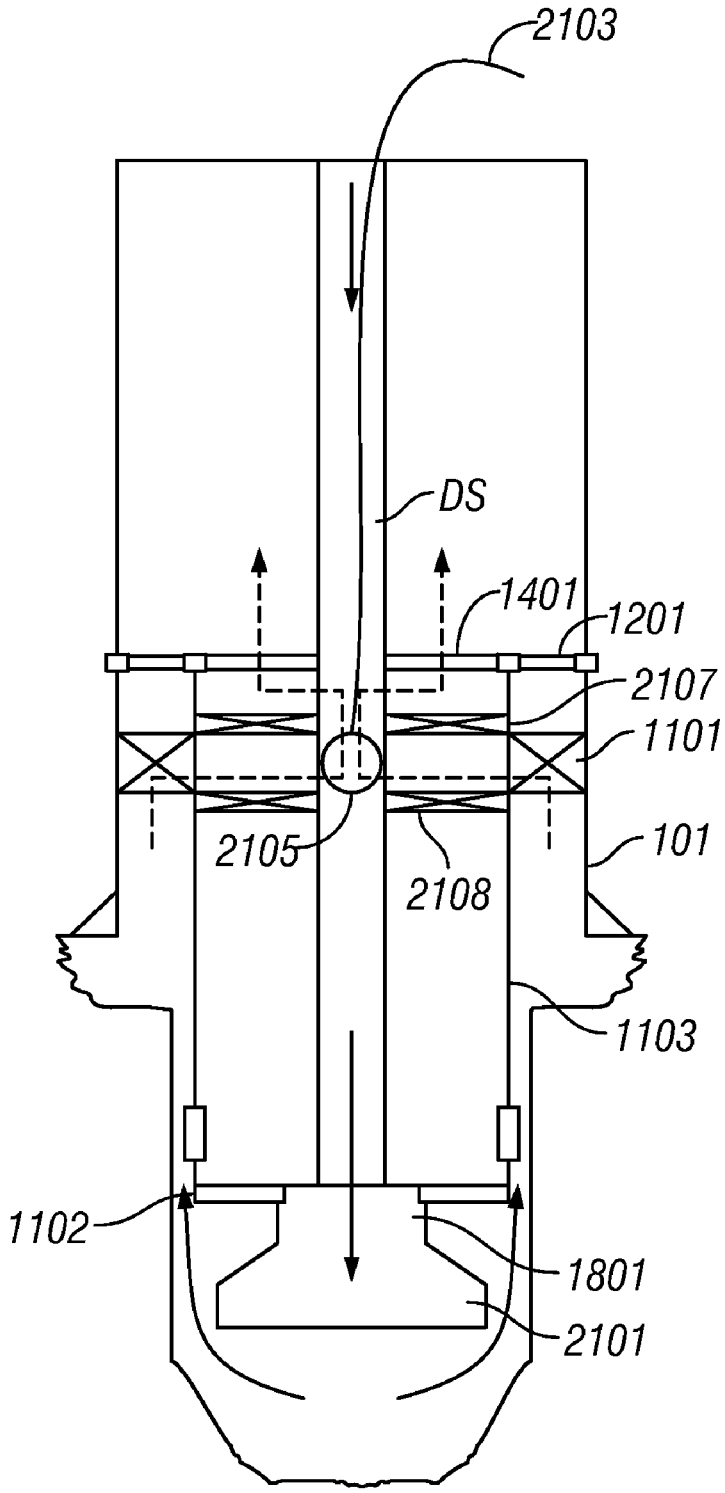

FIG. 14 is a schematic view of the cementing operation that can be accomplished by PGD programmable gradient drilling method. Once a well has been drilled using this system, a long section of open hole with the impermeable formation-strengthening seal remains in place and can include a plurality of external seals. In order to run and cement a casing, cementing operations can then be commenced and completed in a manner that does not violate the pressures preserved behind the seal. This can be accomplished by using the well profile obtained from the control unit C to design a casing string with isolating packers that can be selectively staged and cemented using a downhole system that controls the circulating pressure of cement across the zone being cemented. Accordingly, for example, to cement a depleted zone a light weight slurry would be injected using a packer system such that the light weight slurry to be selectively placed across the depleted zone only and preserving the rest of the zones from this portion of the cementing job.

FIG. 14 is a schematic view of the cementing operation that can be accomplished by programmable pressure drilling method to complete the well. A cementing drill string DS is lowered providing the hang-off latch 1401 to engage tie-back tubing latch profile 1201, an external casing packer 2107 to provide a seal between the drill string DS and the tie-back tubing 1103, and a casing shoe 2101 capable of insertion through the bottom assembly valve 1801 or already incorporated in BHA as fully understood by those familiar with the art of casing drilling. The downhole pump 2105 is run with the drill string DS. An electric wireline cable 2103 is run to power it. Downhole pump 2105 is connected such that it takes its input from the annulus in the open hole and its output is delivered to the annulus between DS and casing 101 above. The purpose of the downhole pump is only to provide downhole control on pressure. A surface cementing set up is used as normal in coordination with the downhole pump so that a different pressure gradient can be achieved in the open hole during the cementing operation; although it is expected that less surface pump pressure will be required because of the timely removal of fluid from the open hole portion of the cementing zone as cement is added to the openhole annulus. The downhole pump therefore adds energy into the system so that fragile, pressure-sensitive zones can be successfully cemented without fluid or cement loss often experienced in such completions. Electric wire and local sensors give full control on pump's operation and ability to maintain a pressure difference across the seals 1101, 2107 and 2108. Since the pump 2105 is located in the well, pump pressure could be instantly regulated to prevent blowing out the open hole well formation because of excessive pump pressure. Cement would circulate down below the preset pressure zone seal 1101 into the open hole and around the distal end of the casing to complete the cement job. Since the well is freshly drilled and drilling fluid has not been allowed to circulate around the bit and up the annulus as found in most conventional drilling programs, the formation will have little filter cake and cementing operations can be readily and easily accomplished, with improved bonding of the cement to the open hole wall. This technique could be used for any number of production zones, separated by external casing packers, while maintaining the pressure zone integrity of each productive zone throughout the drilling of the well. Since each pressure zone is identified immediately by control unit C, such information can be used for cementing purposes consistent with experienced pressure zone gradients throughout the drilling program.

FIGS. 15A-15E depict a schematic of steps of achieving PGD programmable gradient drilling and completion while performing PPD using a movable control unit C and a movable and incrementally deployable seal unit S. In addition to performing the functions necessary for PPD as already explained earlier, control unit C can alternatively activate seal unit S to deploy a sealant such as an intelligent mud cake or a mechanical barrier such as a wellbore strengthening sleeve as more fully described herein. Alternative embodiments could provide an expandable packer, an expandable casing system which is deployed by a swage against the interior wall of the packer, or any other form of bore hole stabilization currently available in this art.

Finally, once the programmable pressure zone has been drilled and strengthened, the control unit C will equalize pressure in the overbalanced zone 112 with the underbalanced zone 110 and release the seal for further operations in the well bore. This process can be repeated as often as necessary or incrementally in a simultaneous fashion to preserve the integrity of the well bore, while detecting likely zones for completion and perforation. Since drilling does not occur in an overbalanced condition in these zones and the formation remains unclogged with high pressure drilling mud cake, expensive and time consuming well preparation does not have be undertaken to commence production.

Figure 15A:
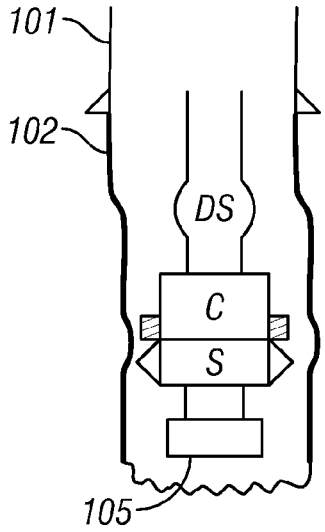
Figure 15B:
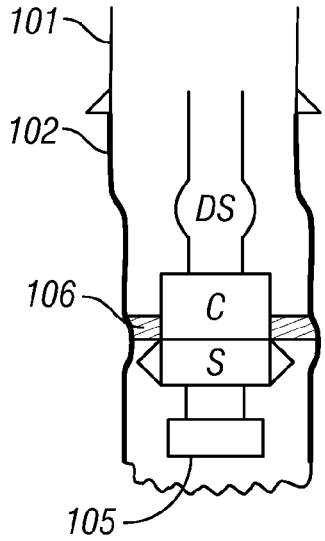
Figure 15C:
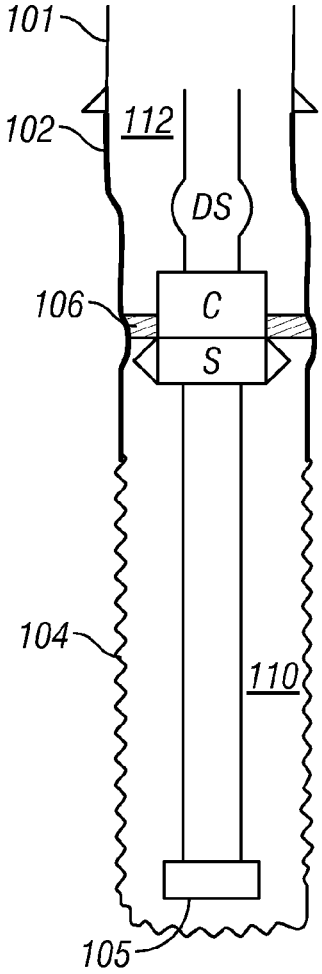

FIG. 15A describes the movement of a control unit C and seal unit S adjacent a drill bit 105 at the distal end of a drill string DS prior to engagement of the seal against a open hole well bore wall in a strengthened or stable formation 102, below casing 101. FIG. 15B describes the setting of the programmable pressure zone seal 106 against an open bore hole face within the strengthened or stable well bore face 102. FIG. 15C shows the continued drilling with drill bit 105 below the seal 106, previously set against the strengthened or stable well bore face 102 into an unconsolidated or unstable portion of the bore hole 104. Pressure in the annular programmable pressure zone 110 is controlled by control unit C to remain below the formation pressure or within the pore pressure frac pressure window by removing drilling fluid from the programmable pressure zone 110 into the overbalanced annular zone above the seal 112 which provides sufficient safety from well blow outs and the like. Other drilling equipment, such as directional drilling systems, measure while drilling (MWD) units, additional formation evaluation systems well know to those skilled in the drilling industry could be additionally supplied below the control unit C without departing from the spirit or purpose of this disclosure. Additionally, the drill string DS shown in FIGS. 15A-15E can be coiled tubing, composite tubing or any other conduit to return drilling fluid from the programmable pressure zone of the present invention.

Control unit C can continuously sample natural flow from the pore structure of the unconsolidated formations and communicate such information to the surface for analysis by the operator or supply it for use directly in an automatic down hole control system, all in a manner well know in this art.

Since the programmable pressure zone 110 is maintained below the pore pressure bottom hole pressure, and compositional measurements are all available with existing technology prior to casing or strengthening of the well bore with mud cake, as might occur in normal drilling operations, detailed information is made available regarding the geophysical structures and productivity of layers through which drilling is being accomplished. Streaming potential of the adjacent formation can be readily measured using techniques such as that described in U.S. Patent Publication No. 2006-0125474, which is incorporated herein by reference. The heightened ability to measure while drilling provides an opportunity for dynamic well profiles previously difficult to obtain, for example to steer the well path to remain within the most productive layers of extended reach well systems.

Figure 15D:
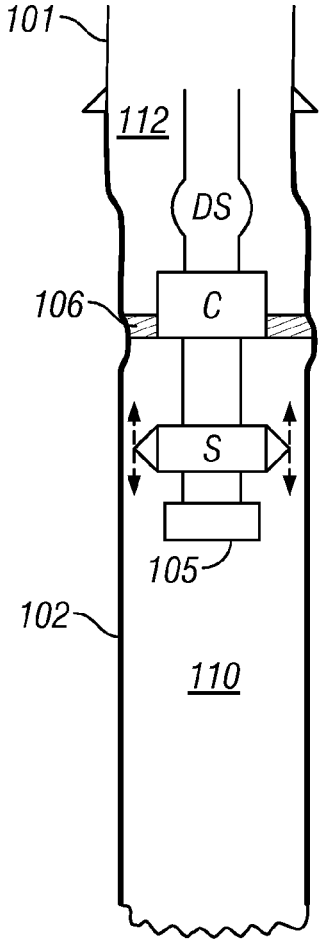
Figure 15E:
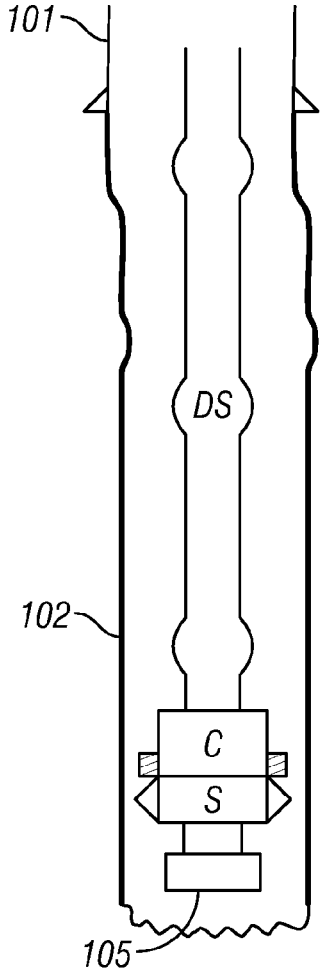

FIG. 15D describes the steps of strengthening the open well bore after sensing and relaying all necessary information to the surface. By manipulation of the drill string, as more described herein, the formation can be strengthened or stabilized to allow further well development. Strengthening can consist of sealing by interposing a mechanical sealant against the well bore face such as without limitation slotted liners, sand screens, expandable sand screens, open hole gravel pack, casing with open hole packers, and expandable tubulars. Expandable tubulars such as sand screens can expand from 33% to 55% of their original outer diameter. Solid liners are limited to expand generally between 5% and 16% of their original diameter. Interlocking strips which can be deployed from coils at the surface and which upon installation form a continuous supporting member, as described in U.S. Pat. Nos. 6,250,385 and 6,679,334 are described in more detail later in this application. Chemical skins can also be set to form a temporary bridge to await replacement by a steel casing thereby extending the borehole length drilled as a single diameter or for the well to be completed as a single diameter i.e. monobore. Disclosed herein is an embodiment for setting a sleeve against the well bore surface as drilling progresses to strengthen the open hole and preserve the integrity of the open hole structure. Applicants believe all known well bore strengthening techniques can be adapted for use with this method of programmable pressure zone drilling and nothing contained herein should be construed as limiting this disclosure to any particular manner of well bore stabilization. After the formation is strengthened or stabilized 102, pressure in the programmable pressure zone can be normalized with the hydrostatic head existing above the seal 106 and the seal released, all as more fully shown in FIG. 15E.

FIG. 16 is a schematic diagram of one embodiment of an apparatus for practicing the PGD programmable gradient drilling and completion of the present invention.

Flow 1 from the surface drives a mud motor 2 which providing motive power to an electrical generator 3 as the electrical power source for a power distribution and control system 4. A seal or pressure boundary 7 isolates the upper 39 and lower 25 chambers and is adapted to move along the bore hole wall 28. The use of the term upper and lower should not be interpreted to describe the physical relation of the two chambers with respect to gravity since the lower chamber can be geocentrically above the upper chamber in horizontal drilling situations.

The bore hole contact interface of the seal body 7 is an inch-worm arrangement 8—not shown in detail—where two packers are alternately pressurized and "inched" as drilling progresses to maintain a continuous seal with the well bore wall 28. Other seal arrangement can be adapted to maintain a moveable seal between the upper 39 and lower 25 chambers as drilling progress without departing from the spirit or purpose of this arrangement. Yet another embodiment for the implementation of the moveable seal is discussed below.

A first electric motor and mud pump 5 are controlled by power distribution and control system 4 to deliver mud through the pressure seal 7 utilizing conduit 24. A second electric motor and pump 31 acts similarly by moving mud through seal 7 from the lower chamber to the upper chamber using conduit 15. Using a first pressure sensor 29 in the lower chamber and a second pressure sensor 30 in the upper chamber, the control system 4 adjusts the speeds of the electric pumps to achieve the required pressure management of lower chamber 25, thereby achieving conditions equivalent to underbalanced drilling without the complications and expense of the surface equipment normally required. It should be noted that the placement of one or more pressure sensors, such as the one represented at pressure sensor 29, can be at any location within the programmable pressure zone without departing from the scope of this invention, as needed for the drilling program being carried out.

The mud flow through conduit 15 is drawn from circulating conduits 10 through the bit 11 and reamer body circulating conduit 13 through the underreamer 12, all in a manner well known to the drilling industry. This reversed circulation flow entrains the rock cuttings in the flow—ultimately to be transported to the surface via telescoping conduit 41 in a manner similar to all open circulation drilling mud systems. The telescoping conduit 41 connects with the casing 16 to permit the sleeve-seal 19 to be loaded from the surface in its transport container 18 and thereby permitting the transport container 18 to traverse the casing connection to the sleeve-seal 19.

The reverse circulation conduit 15 joins upper chamber return flow conduit 21 downstream of the connection with flow conduit 22 providing fluid flow to drive motor and pump 5 to avoid the cuttings being recirculated through bit 11 and reamer 12 and a reverse flow protection valve 34 affords additional protection from such cuttings return to the lower chamber 25. The cuttings and exhaust flows of the mud motor 2 and the cuttings flow conduit 15 are returned to the surface through the annulus between the casing 16 and the borehole wall 28, all in a manner well known in this industry. A recirculation valve 14 is used to vary the flow through reamer recirculation conduit 13 such that both the bit 11 and reamer 12 have balanced flow conditions appropriate to their cutting needs, which flow rate is controlled in real time by power distribution and control system 4.

The second electric motor 6 rotates the reamer 12 and a third electric motor 26 rotates the rotary steerable system (RSS) 27 for controlling directional steering of the bit 11 for drilling a pilot hole 40.

The casing 16 extends to the surface and is to be left in place. Underreamer 12 is required to open the pilot hole 40 to width sufficient to allow insertion of the casing 16 into the bore hole. The programmable pressure system equipment will then be recovered to the surface once the drilling is complete through the casing 16.

The seal-carrier 18 is latched to a second section of casing 37 and this is connected to the first section of casing 16 using a rotary bearing 17. This rotary bearing 17 is lockable—not shown—so that first casing 16 and transport container 18 and the second section of casing 37 can be rotated together as needed. The sleeve-seal 19 is contained in the seal-carrier 18 and is fed out over rollers 20 which puncture compartments in the sleeve-seal 19 to release a bonding agent 36 which sticks and seals the sleeve-seal 19 to the well bore wall adjacent the rollers 20.

The forward motion of the system is determined by the speed of sleeve-seal 19 curing and that of drilling. Sensors can be deployed in the sleeve-seal 19 (not shown) to determine the state of seal curing thereby providing a signal to the power distribution and control unit 4 to continue forward optimizing the speed of drilling. The coordination of the sleeve-seal cure rate of the sleeve-seal 19 with the forward drilling speed provides critical real-time input to the surface to adjust the casing descent requirement. This information, transmitted in real time to the surface, can be provided by the wired drill pipe connection 32 from the power distribution and control module 4 to control the draw works/top drive system speed of descent. The same speed information is provided to the inch-worm sleeve-seal so that it moves in unison with the casing 16 as it is advanced into the borehole.

Under normal drilling conditions, the seal 7 would be retracted (i.e. the inch worm packers both deflated) until another area requiring pressure management was encountered.

When a region of formation is encountered where sealing is required the inch-worm seals 8 are energized and the casing lock-on 17 is released in order for casing 16 to rotate and for seal-carrier body 18 not to rotate (to avoid the seal from being exposed to a rotating casing before it is set). The roller system 20—which is motorized (not shown) would drive out the sleeve seal 19 as the system drills ahead. The inch worm seals 8 would also have to take the drilling reactive loads from the bit 11 and reamer 12. To minimize this effect, the bit 11 and reamer 12 can be rotated in opposite directions to balance the torque.

The main pressure sealing work performed during drilling is achieved by inch-worm seals 8 until the sleeve-seal 19 is cured or set sufficiently to be exposed to the full casing-borehole annulus pressure.

Alternatively, the novel methods described herein of isolating a pressure zone adjacent the drill bit and reamer of a bottom hole assembly can be accomplished by other alternative embodiments. For example, as shown in FIGS. 17-20, a tractorable toroidal sleeve can be provided to act as a seal between the lower chamber (such as 270 in FIG. 17 or 380 of FIG. 18) adjacent the drill bit of this system and the upper chamber (260 in FIG. 17 or 370 in FIG. 18) as described herein. Motive power for this tractorable toroidal sleeve can be provided by electromotive means or mechanically, such as by the mud motor drive of FIG. 19. The tractor exerts a pull/push depending on its rotation direction which could be driven by drill pipe rotation or any other energy available down hole. As shown in FIG. 17, tractor 250 and tractor body 230 are slideably carried on drill pipe 220 which is sealed by dynamic seals 240.

Alternatively, toroidal seal carrier 230 can be rotatably connected to drill pipe 220 and pressure retaining rotary bearings can be substituted for dynamic seals 240 thereby providing the means by which the toroidal seal would be driven by pushing and pulling on the drill pipe 220. Drilling mud forcibly moving between tractor 250 and tractor body 230, along with the frictional force of the tractor's exterior surface dragging alone the formation 210 would cause the toroid 250 to slide over its carrier 230.

Alternatively, as shown in FIG. 18, carrier 320 can use castellation tracks on toroidal sleeve 350 to engage with mating tractor body 320 which again is rotatably connected to drill pipe 310. Similarly, as shown in FIG. 19, the motive force for the movement of the tractor 530 and sleeve 550 results from the hydraulic force associated with the movement of a mud motor stator 530 with rotor 547 and stator 546 moving a drive ring 543 thereby moving drive dogs 545 over the castellated tractor 530 and tractor body 550.

In either case, whether in FIG. 17, FIG. 18, or FIG. 19 the speed of carrier rotation 230, 320, 530 has to match a target traction/tractoring speed consistent with drill pipe movement requirements.

Alternatively, as shown schematically in FIG. 20, a spiral grooved interior surface of the seal 510 mates with a spiral drive mechanism 511 (toroidal tractor) mounted on the drill pipe like a large rubber coated screw 512. Spiral grooves on the interior surface of the seal 510 contain chemical sealing agents 513 activated by the compression of the seal 510 against the well bore wall 210 thereby being available to strengthen the wall as the interior surface is turned inside out against the exterior well bore wall 210, all in a manner well know in the down hole drilling additives industry.

See FIG. 21A-21C for schematic representation of several alternative means for delivery of these sealing agents to the borehole wall. The corrugated or spring loaded grooves of FIG. 21A while sufficiently mechanically strong to bear the longitudinal loading caused by the tractoring are relatively weak against radial forces created and is expanded as in FIG. 21 B as the sleeve makes a turn around expanding against borehole wall thereby releasing the chemical sealing agents from the corrugated pockets as shown in FIG. 21C when expanded radially. Whether accomplished by the device shown in FIG. 20, the bag 512 turned inside out such that the outer surface sticks to the wall and the inner surface is being driven forward by the screw 510 or the slotted member which is compressed to open the chemical sealant for deployment against the well bore wall, each provides a chemical strengthening seal of the well bore. The chemical reaction created by the crushing of the bag 512 against the adjacent wall of the well bore 210 forms an impermeable seal as the grooves of the sleeve release the sealing agent. The exterior surface of the sleeve 510 is designed to reduce friction as it has to slip/slide against itself and is also compressed against the borehole wall by the radial force of the toroidal tractor. This radial force F as shown in FIG. 22, similar to the compressive force of the screw against the bag and adjacent well bore wall shown in FIGS. 20 and 22, also creates a seal between the well bore section below the toroidal tractor and the section above and also helps impregnate the chemicals that are released from the spiral grooves against the borehole wall to form a strengthening pressure barrier to permit working of the formation.

As more fully shown in FIG. 22, although principally intended to deploy the sealing bag member 512 against the well bore wall, the tractor grooves 510 mesh with the grooves on expandable sleeve 512 to drive sealant 801 to strengthen the formation freshly drilled by drilling assembly 105, all as previously described. The open hole 110 is sealed from the annulus 112 by the engagement of the tractor T. In this embodiment, control unit C is combined with the tractor T.

Figure 23A:
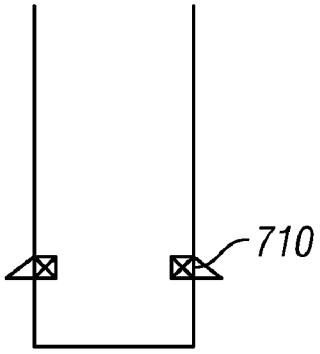
Figure 23B:
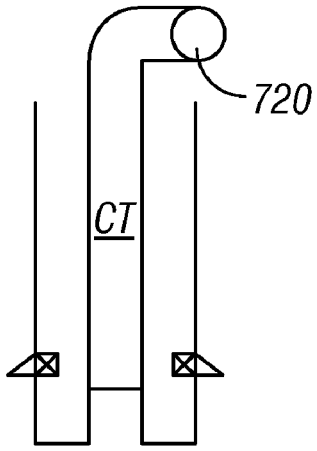
Figure 23C:
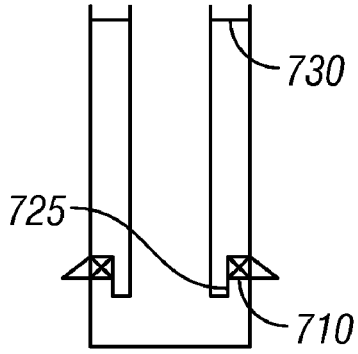
Figure 23D:
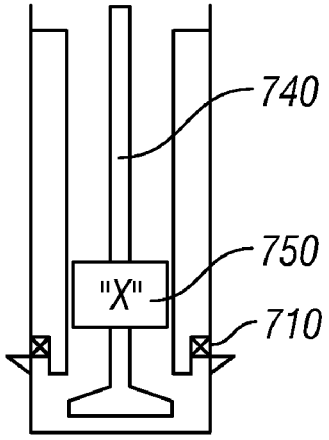
Figure 23E:
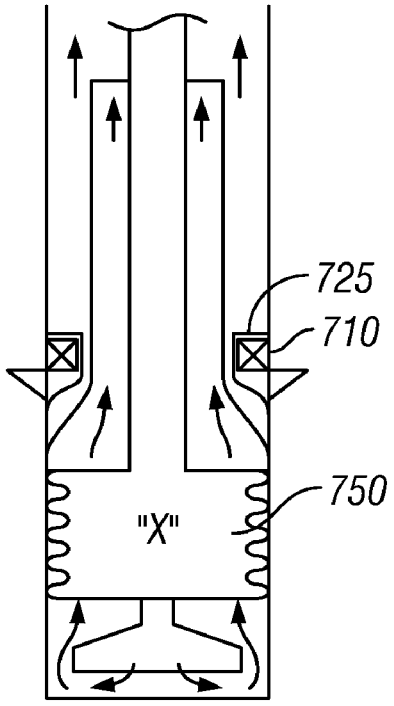

The sealing bag embodiment shown in FIG. 22 can be stored on surface as a reel (similar to coiled tubing CT) and then deployed by lowering into well bore prior to drilling. The sequence of setting this type of spiral seal embodiment in a well bore is described in FIG. 23A-23E. A latching packer 710 in FIG. 23A would be set just above last casing shoe using a wireline set packer system common in the industry. The sealing bag can then be deployed by run in from surface coil 720 (FIG. 23B) and its lower end 725 latched into the packer 710 (FIG. 23C). The upper end of the sleeve/seal 730 is then cut and hung off at surface. Drill pipe 740 in FIG. 23D is then lowered in the well through the seal with the toroidal tractor 750 in closed or deactivated position. Once the tractor on the drill pipe reaches a position proximal to the packer 710, it is inflated/activated to mate with the spiral grooves on the seal's internal surface in FIG. 23E. The upper end of the seal is then latched to the drill pipe. As drilling progresses, toroidal tractor pulls the sleeve down to match the drilling speed. The lower end of seal 725 stays fixed at the packer 710 and its upper end moves down as drilling progresses. The sleeve or bag reverses on itself in the open hole such that the interior surface reverses and comes in contact with borehole wall while at the same time releasing chemicals that create an impermeable strengthening barrier in the open hole, all as previously described herein.

Finally, the programmable gradient drilling can permit the drilling and simultaneous installation of stripping which when deployed against the well bore wall would stabilize and support the wall as continued drilling progresses without the need for additional special equipment. The deployment of strip or helically wound tubular structures in well is well known. See U.S. Pat. Nos. 6,679,334 and 6,250,385, both of which are incorporated herein by reference. This strip technology can be adapted to add the stability to the adjacent well bore wall as the drilling progresses.

As more fully described in FIG. 24, a drilling apparatus similar to those previously described herein provides the additional feature of a strip applicator 2203 so that the helical strips 2201 described in the prior referenced applications is moved by the drilling assembly as drilling progresses. Helical strip 2201 is moved from surface reel 2200 down the annulus of a well bore where it is carried by the pump assembly and BHA through entry seal 2204 and into the programmable pressure zone through seal 2205. The entry seal 2204 is a rotating seal that allows the drill string DS and the BHA to rotate relative to the strip 2201. Applicator arm 2203 moves as the assembly is rotated to move the strip onto the well bore where toroidal roller 2215 compresses the adjoining strips into contact with the well bore thereby providing support and stabilizing the well bore formation while drilling progresses. Alternately, applicator arm 2203 could be motorized (not shown) and mounted using the rotating seal 2204 to allow it to be rotated independent of drill string DS at controlled speed. Since drilling fluid 2220 at the standard pump pressure is diverted by diversion valves 2210 and flow control valve 2212 regulates the flow of drilling fluid into the programmable drilling zone, pressure is maintained at the formation natural pressure. The reverse circulation pump P of the present embodiment operates in the same manner as the pumps in other embodiments of this invention. The drilling and simultaneous deployment of the interlocking strip material of the present invention permits safe overbalanced protection in a programmable pressure zone drilling of the present invention, with standard drilling rig equipment, with the full protection of the formation with the engaged interlocking strips which can be later completed with conventional completion techniques.

Applicants believe the present application presents a substantially new opportunity to safely drill in formations previously thought too fragile to permit successful drilling programs. Near instantaneous pressure changes can be accomplished by a number of current techniques that can be adopted for use with this programmable pressure zone drilling method. For example, streaming potential of the strata adjacent the bottom hole assembly could be measured by sonic excitation of the strata, all as more fully described in U.S. Patent Publ. App. 2006-0125474 incorporated herein by reference for all purposes, which can indicate formation pressure which can then be acquired and used by the control unit in conjunction with flow rates of drilling fluid into and out of the programmable pressure drilling zone. If the strata formation pore pressure drops, such as in a depleted strata, drilling fluid pressure can be lowered to prevent well bore wall collapse from the hydrostatic pressure of the drilling fluid. Similarly, if formation pressure is sensed to have increased, drilling fluid pressure can be increased to maintain the natural pressure until that portion of the well could be cased.

Because of the limited size of the programmable pressure drilling zone 110, pressure differentials can be readily controlled and adjustments made to obtain optimum performance of the drill bit while safely maintaining the integrity of the formation. It is possible to switch at any time from programmable pressure zone drilling to regular open loop drilling when such drilling is not required.

Other embodiments, include setting a liner hanger having a slick interior bore allowing a sealing surface to seal as programmable pressure zone drilling progresses while permitting the longitudinal movement of a drill string through the slick interior bore are described below. The isolated and drilled zone could then be cemented, cased or stabilized with appropriate chemical bridging solutions well known in the drilling industry. Since the control unit is capable of sensing well bore conditions in the managed drilling zone, substantial open hole information can be collected and logging may be complete without the interference of hydrostatic pressure overwhelming the porosity or flow characteristics of the open hole. This dynamic well profile will allow future management of not only the well drilled but will provide substantial production zone information previously hidden by regular drilling techniques. The covariance of data collected from nearby wells with drilling information in real time should permit correlation of information on field-wide basis. Fracture networking and propagation in tight reservoirs can be studied when using this programmable pressure zone drilling method. A fracture in a programmable pressure zone well can cause other pressure and temperature changes in offset wells providing a guide for geophysical interpretation of the wells and fractures in the field under study.

The development of this process should increase the ability of a driller or an automatic trajectory control system (at surface or down hole) to steer or allow the development of auto-steering drilling assemblies which accept the information and data collected by the control unit C, including any formation evaluation data, to guide the drill string to the appropriate target zone.

Since the present method provides a complete well profile obtained by the control unit as drilling progresses, a cementing program can be readily designed and implemented which permits each strata encountered in the entire well bore to be cemented in the most efficient and formation-preserving manner. For example, if an unconsolidated zone is detected, a cement slurry consistent with the formation pressure can be delivered to the formation once isolation packers are set to isolate that zone, all in a manner well known in the art of oil well cementing operations. The use of the programmable pressure drilling zone method permits the use of specifically designed cementing programs for each problem strata.

It may also be readily appreciated in view of the foregoing disclosure that, as a result of the well bore strengthening accomplished in the open hole drilling program permitted by this programmable pressure drilling apparatus significant sections of the well bore can be cased with a monobore casing thereby creating a full bore well to the productive zones without restrictions in the size of the casing. Once cemented into place, while preserving the integrity of the well bore because of the well profile obtained by the present invention, higher production can be obtained from the well while preserving the integrity of the production formation through which the well is drilled because of the monobore production casing permitted to be set using this method of programmable pressure drilling.

Programmable pressure drilling and programmable gradient drilling permit near instantaneous adjustment of pressure differential between the formation pressure and the well bore annulus pressure. There is no requirement to alter mud characteristics based upon formation changes during a drilling program. Near instantaneous measurement of drilling parameters such as flow, pressure, weight on bit, torque and drag can be sensed and sent to the drilling manager or drilling control system by the control unit. Immediate access to well formation characteristics and the productivity of all strata experienced while drilling, as well as short duration testing and characterization of the well (build ups and draw downs) can be measured in the unconsolidated formation and sent to the surface for analysis. While hydrocarbons may flow to the surface mixed in the drilling mud from the unconsolidated formation, the volume of such production will be small and controllable down hole by the control unit C and no adverse pressure differences will be experienced at the surface from these minimal releases. This presents a significant application of this technique in exploration wells where a large number of uncertainties exist; for example, mud design and properties required, casing design, formation evaluation and testing technologies to be used. By deploying this invention, operators will be able to drill exploration wells with minimum risk as mud design will be simplified, casings reduced, measurements obtained of well's productivity while drilling without formation damage, thereby allowing the most accurate and very first determination of reservoir or productive zone's exact location and the reservoir or zone's true potential.

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

What is claimed is:

1. A method for programmable pressure drilling comprising:

forming an annular seal at a distal end of a drill string to create a first pressure zone and a second pressure zone in a well bore;

sensing pressure in both the first pressure zone and the second pressure zone;

adjusting pressure between the first pressure zone and the second pressure zone to achieve a specific pressure gradient; and drilling within the first pressure zone in the well bore while dynamically adjusting pressure in the first pressure zone, and while maintaining the annular seal.

2. The method of claim 1 further comprising strengthening the first pressure zone in the well bore.

3. The method of claim 1 further comprising equalizing pressure in the first pressure zone with the pressure in the second pressure zone.

4. The method of claim 3 further comprising advancing the drilling in the first pressure zone, after equalizing, and sealing at a different point in a well bore.

5. The method of claim 2 further comprising hydraulically isolating the first pressure zone.

6. The method of claim 2 wherein the step of strengthening comprises one of the following selected methods for stabilizing the first pressure zone: coating the well bore with a sealant; deploying a sleeve, cementing a casing in place, expanding an expandable tubular, inserting and deploying an interlocking continuous strip, or gravel packing.

7. The method of claim 1 further comprising continuously monitoring formation pressure and depth within the first pressure zone thereby providing a streaming potential profile of the drilled well.

8. The method of claim 7 further comprising modulating pressure in the first pressure zone and measuring the streaming potential to determine formation pressure and permeability.

9. The method of claim 1 further comprising continuously exciting the formation with sonic energy and measuring sonic velocity in the formation while modulating pressure in the first pressure zone thereby detecting formation characteristics without fracturing the first pressure zone.

10. The method of claim 1 further comprising transmitting well information dynamically while drilling from the first pressure zone to the surface and receiving control signals back from the surface.

11. The method of claim 10 wherein the well information is transmitted through wired drill pipe.

12. The method of claim 1 further comprising determining productivity potential of each pressure zone in the well as it is being drilled in the first pressure zone.

13. The method of claim 1 further comprising steering a drill bit within the first pressure zone utilizing information determined by a control unit communicating with one or more sensors located within the first pressure zone.

14. A method for programmable pressure drilling of a well bore comprising:

disposing an annular seal proximal to a distal end of a drill pipe equipped with a bottom hole assembly, said annular seal allowing continuous movement of the drill pipe;

engaging the annular seal with the well bore to form an alterable annular pressure in an annulus adjacent the bottom hole assembly below the seal in said well bore;

drilling the well bore utilizing the bottom hole assembly while maintaining the annular seal; and maintaining the well bore pressure on a distal side of the seal during the drilling of the bore at a pressure different from a pressure on a proximal side of the seal.

15. The method of claim 14 further comprising removing drilling fluid and cuttings through said seal without releasing said seal.

16. The method of claim 14 wherein the pressure in the well bore is lower than the pressure in an annulus on an opposing side of the annular seal.

* * * * *